US005906397A

United States Patent [19]

MacWilliams et al.

[11] Patent Number: 5,906,397

[45] Date of Patent: May 25, 1999

[54] FILE FOLDER AND METHOD

[75] Inventors: Steve C. MacWilliams, 1211 Anita Pl., Fullerton, Calif. 92631; Frank C. Kezmoh, Huntington Beach, Calif.

[73] Assignee: Steve C. MacWilliams, Fullerton, Calif.

[21] Appl. No.: 08/418,522

[22] Filed: Apr. 7, 1995

[51] Int. Cl.[6] ..... B42F 21/00

[52] U.S. Cl. ..... 283/36; 40/359; 281/45

[58] Field of Search ..... 283/36, 37, 41, 283/42; 40/359; 281/29, 45

[56] References Cited

U.S. PATENT DOCUMENTS

| | | | |
|---|---|---|---|
| 3,962,807 | 6/1976 | Pantone . | |
| 4,240,848 | 12/1980 | Barber . | |
| 4,329,191 | 5/1982 | Barber . | |
| 4,445,711 | 5/1984 | Cunningham | 283/39 X |
| 4,507,883 | 4/1985 | Tarrant . | |
| 4,523,276 | 6/1985 | Maejima et al. . | |
| 4,523,776 | 6/1985 | Barber | 283/39 |
| 4,560,600 | 12/1985 | Yellin et al. . | |
| 4,835,544 | 5/1989 | Winterburn . | |
| 4,939,674 | 7/1990 | Price et al. . | |
| 4,978,142 | 12/1990 | Kaluza . | |
| 5,007,663 | 4/1991 | Moran . | |
| 5,011,189 | 4/1991 | Olson . | |
| 5,029,903 | 7/1991 | Pennock . | |
| 5,083,816 | 1/1992 | Folga et al. | 283/41 X |
| 5,129,682 | 7/1992 | Ashby . | |
| 5,174,606 | 12/1992 | Hure . | |
| 5,195,123 | 3/1993 | Clement . | |
| 5,197,764 | 3/1993 | Hicinbothem et al. . | |
| 5,219,183 | 6/1993 | McKillip . | |
| 5,254,381 | 10/1993 | Hoffmann et al. . | |
| 5,316,344 | 5/1994 | Popat et al. . | |
| 5,468,085 | 11/1995 | Kline | 283/41 X |

FOREIGN PATENT DOCUMENTS

| | | |
|---|---|---|
| 1172044 | 11/1969 | United Kingdom . |

*Primary Examiner*—Willmon Fridie, Jr.
*Attorney, Agent, or Firm*—Knobbe, Martens Olson and Bear, LLP

[57] ABSTRACT

An improved file folder specially adapted to conventional printers and optical scanners and a system and method for printing and using the improved folder. The improved folder has an enclosure for holding documents and printable panels with an integrated tab and integrated document labels. The folder panels, integrated tab and labels are printed with machine-readable identifying indicia and text in one pass through a standard printer. The tab is foldable such that folder identifying indicia and text are visible from either the front or back side of the folder. After printing, the documents labels are removable and affixable to the folder documents. Images of the folder documents are captured with a standard optical scanner which also reads the document identifying indicia printed on the labels. The document images form a database indexed according to the indicia printed on the document labels. The folder is printed with indicia designating it as a document separator and the folder is scanned along with the folder documents.

22 Claims, 33 Drawing Sheets

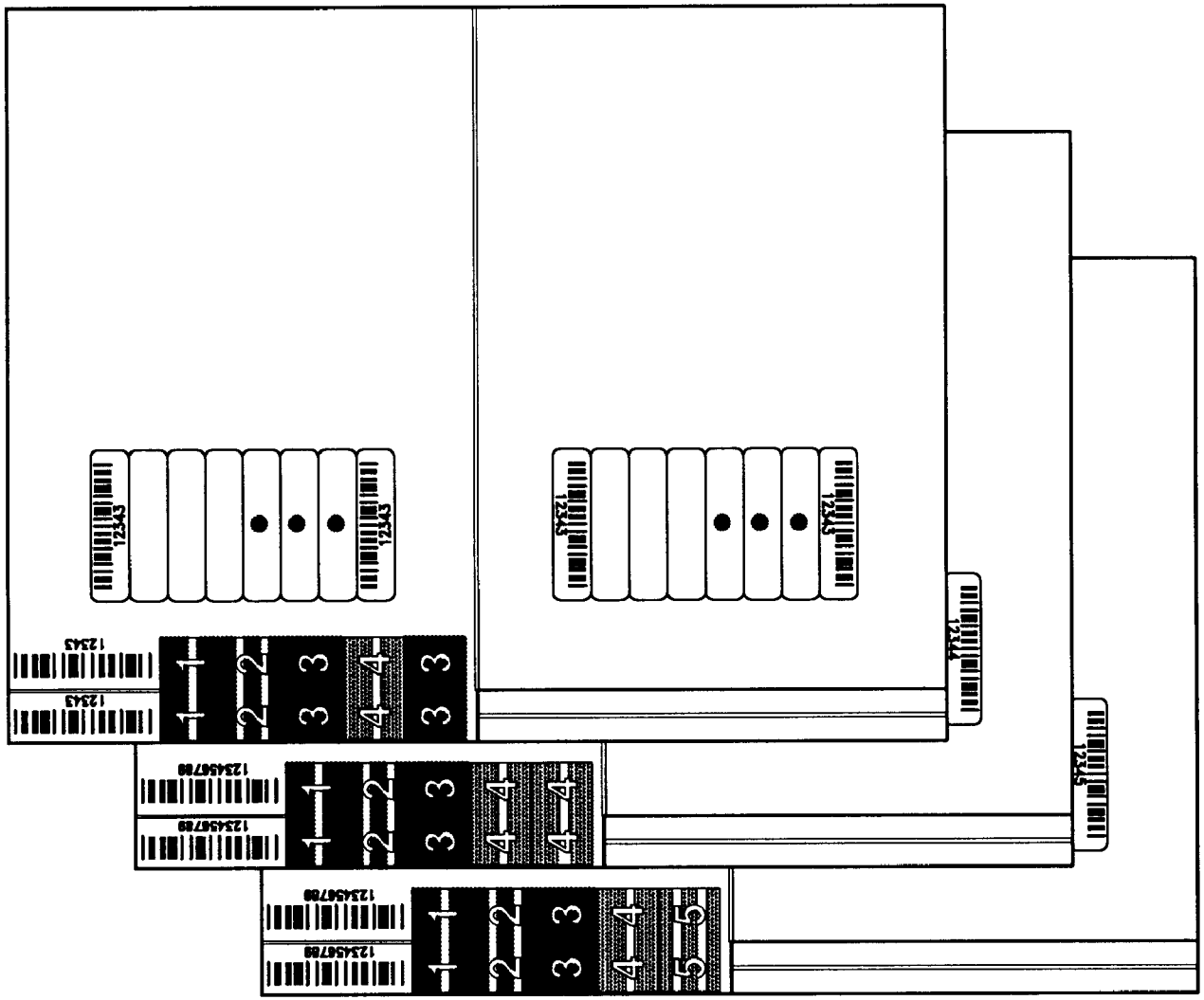
12345
12345
12345

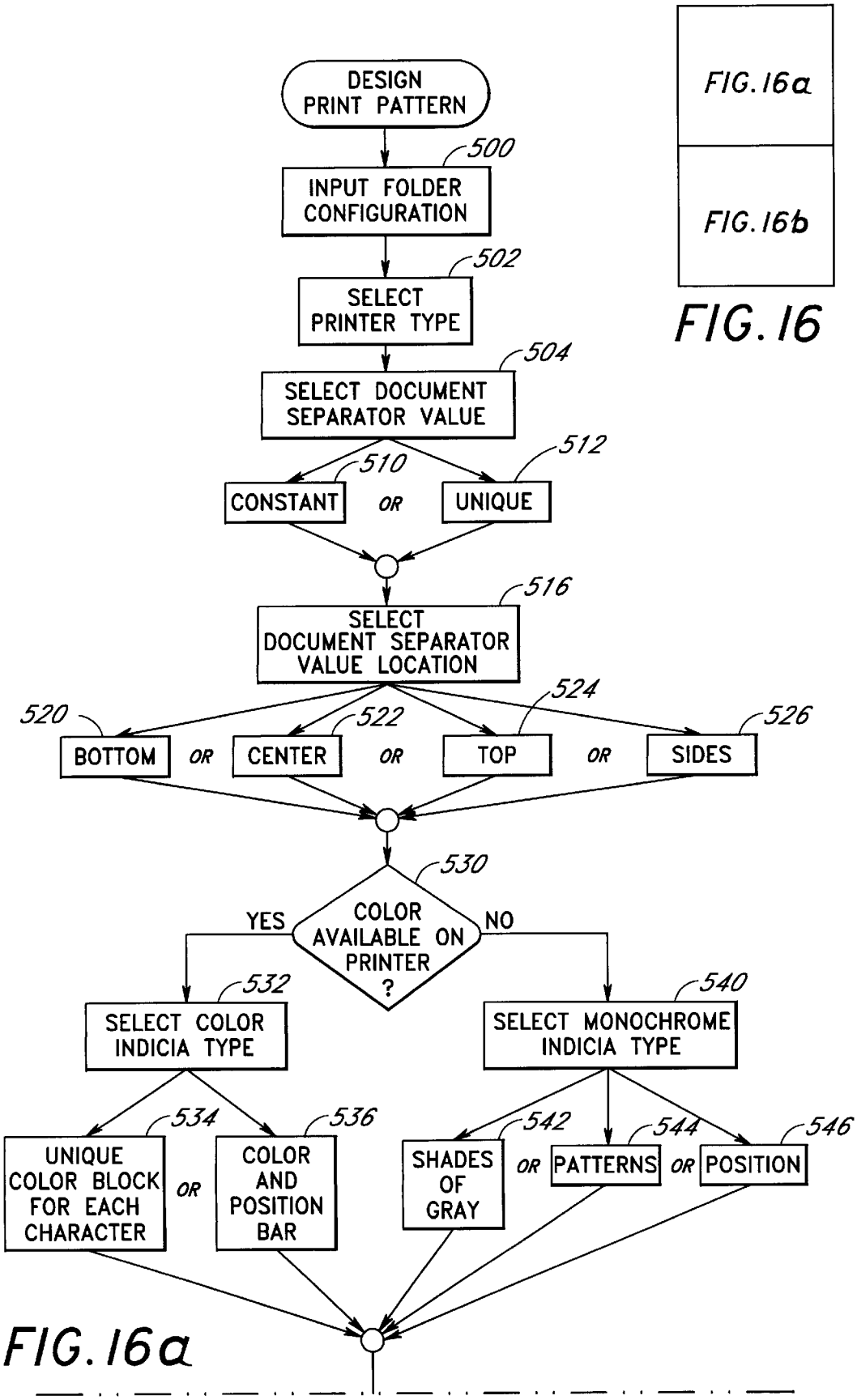
FIG. 16a
FIG. 16b
FIG. 16
DESIGN PRINT PATTERN
500
INPUT FOLDER CONFIGURATION
502
SELECT PRINTER TYPE
504
SELECT DOCUMENT SEPARATOR VALUE
510
512
CONSTANT
OR
UNIQUE
516
SELECT DOCUMENT SEPARATOR VALUE LOCATION
520
522
524
526
BOTTOM
OR
CENTER
OR
TOP
OR
SIDES
530
COLOR AVAILABLE ON PRINTER ?
YES
NO
532
SELECT COLOR INDICIA TYPE
540
SELECT MONOCHROME INDICIA TYPE
534
536
542
544
546
UNIQUE COLOR BLOCK FOR EACH CHARACTER
OR
COLOR AND POSITION BAR
SHADES OF GRAY
OR
PATTERNS
OR
POSITION
FIG. 16a

FILE FOLDER AND METHOD

FIELD OF THE INVENTION

The present invention relates to the field of document management. More specifically, the present invention relates to an improved document folder specially adapted for use with conventional printers and optical scanners, eliminating the need for separately printed folder labels, document labels and document separators. The present invention also relates to the system and method for printing and using the improved folder.

BACKGROUND OF THE INVENTION

Organizations which require significant amounts of paperwork employ a variety of document filing methods in order to easily access this paperwork. The basic document filing method utilizes folders constructed of heavy paper or cardboard, each of which stores a set of related documents. For example, a medical office might store documents pertaining to an individual patient in a single folder. A bank might store documents pertaining to a specific loan account in a single folder. These folders are maintained side-by-side on a shelf or in a container, such as a file drawer. The folders are typically ordered sequentially on the shelf or in the container according to some convenient scheme, for example alphabetically by last name or numerically by social security number. The folders are labeled according to the chosen sequence for ease of filing, that is the location, retrieval and storage of document folders.

The document management industry has long offered various document folders and methods of labeling these folders to streamline the document filing process. For example, a folder can be pre-printed with identifying categories such as NAME, SUBJECT and FILE NUMBER. Specific identifying information can then be handwritten on the folder according to these categories or an appropriate printed label can be applied. Hand-labeling folders, however, is labor intensive. Further, location of a specific folder requires reading the identifying information on several folders until the desired folder is located.

Color-coded folders are offered to assist the folder filing process. A specific color can be designated to correspond to a particular category of documents. For example, a bank might use yellow folders corresponding to loan documents, blue folders corresponding to savings accounts, etc. Such color coding allows categories of documents to be quickly filed without the need to read and search for specific folder identifying information. This filing system, however, also requires handwritten identification of specific folders. Another drawback to pre-printed and colored folders is the need to maintain an inventory of each unique type of folder. More folder types facilitate filing but increase inventory requirements.

Color-coded labels are offered which can be applied to a folder tab. A tab is the extended portion of the folder used for sight reference when folders are stored in sequence and serves the same purpose as a book spine. The tab is located to be visible when the folder is stored alongside other folders on a shelf or in a container. A drawback to this folder identification scheme, however, is that the application of the color-coded labels is labor-intensive. Also, manually folded and applied labels are prone to mis-registration on the folder tab. These drawbacks become more pronounced as the number of folders in this type of filing system increases.

In addition to efficient document filing methods, the document management industry has offered so-called paperless systems which reduce or eliminate the need to handle physical documents. Image capture systems either photograph documents, storing the documents as micrographic images, or scan documents, storing the documents as digital images on a mass storage device such as compact disk, read-only memory (CD-ROM). A collection of stored document images forms an image database equivalent to a document filing system.

As in any database system, efficient image database access requires an indexing method, much like an index in the back of a book allows quick location of information within the book. An image database is often indexed by attaching a "document label" printed with a unique document identifier to the first page of each document. For example, if the document relates to an individual's file, the document identifier may be the individual's social security number (SSN) concatenated with an abbreviation representing the type of document. Specifically, if a loan application (LA) was filed by an individual with the SSN 012-34-5678, the document label attached to the loan application might be printed with the identifier "012345678LA." The database index can then simply reference that document by that identifier. The identifier is typically printed in "machine-recognizable" form, such as bar codes or optical character recognition (OCR) fonts, along with text.

Another use for document labels is for "element verification," i.e. verification that all documents which belong in a folder are present. Without document labels, element verification is often done manually. A manual element verification system might have each document which should be in a folder listed on the folder front panel. Verification would consist of checking-off each document on the list if it is contained in the folder. If document labels are used, a bar code wand interfaced to a computer can be used to scan the label of each document in a folder. A computer software routine would then automatically verify the index values read from the document labels against a computerized list of documents.

For new files, element verification is used to determine when a folder contains a complete set of documents. In the banking industry, for example, element verification might be used to determine if all documents necessary to evaluate a home loan have been received: the application, credit reports, appraisals, etc. For existing files, element verification serves an auditing function, i.e. verification that no documents are lost or misplaced. Using a banking industry example again, element verification might be used to audit the documentation for various home mortgages prior to sale of the mortgages to another financial institution.

A drawback to image capture systems and automated element verification systems is that document preparation is difficult and labor intensive. Separately printed document labels must first be matched to a specific folder and then to the documents in that folder. These two matching processes are time consuming and complicated by the fact that the document and tab labels are typically generated by different printing processes, adding the step of first matching a tab label to a specific folder. A further drawback to image capture systems is that, typically, all documents to be photographed or scanned are first separated from their folders. The documents are then processed in mass with the documents from each folder being separated by single sheets, called "document separators." The document separators have a bar code label with a "null" value not corresponding to any document label bar code values and located at a specific location. The document separators are recognized by the scanning system as indications of the end of the documents associated with one folder and the beginning of the documents associated with another folder. In this manner, the document images from each folder are kept separate. Typically, however, the document separator itself conveys no other information to the scanning system. That is, the scanning system must read the document page following the document separator in order to identify the folder associated with the next documents to be processed. Ultimately, the documents must be manually reunited with their folders, and documents can be inadvertently placed in the wrong folder with potentially catastrophic results. Another drawback is that a complete set of document labels is typically printed for each folder in a file. Many folders, however, might contain only a small subset of documents, wasting the bulk of the pre-printed labels.

SUMMARY OF THE INVENTION

The present invention is directed to an improved file folder specially adapted to conventional printers and optical scanners, eliminating the need for separately printed folder labels, document labels and document separators. The folder of the present invention is configured with connected front and back panels creating an enclosure in which documents are contained. The front panel on the improved folder has an integrated tab printed with folder specific identifying indicia and then folded such that the indicia are visible from both sides of the folder. This integrated tab eliminates the need to match a separate tab label to a specific folder and to manually apply the label to the folder tab.

In another embodiment of the invention, an improved folder has a panel with adhesive backing affixed to a release liner. Removable labels are die-cut in portions of the panel. These labels can be printed, removed from the panel and attached to documents which are placed in the folder. Because these integrated document labels are printed directly on the folder containing the documents to be labeled, there is no need to manually match document labels to a specific folder. Further, the printing is simplified because folder and document identifying indicia are printed at the same time by the same printing process.

The present invention is also directed to a system for printing the improved folder. A preferred embodiment of the printing system consists of a database, a print pattern, a computer and a printer interfaced to the computer. The computer accesses the database for information associating a database entry for a specific folder to an alphanumeric identifier. The computer also executes a print pattern routine which merges the identifier for each particular folder into a set of printer commands and data common to each folder. The printer has a feeder which guides a blank folder through a printing mechanism which imprints identifying indicia on the folder. The folder is printed according to the print pattern sent to the printer via the computer interface. After printing, the printer ejects the printed folder.

The present invention also is directed to a method of using the improved folder. For a specific filing application, the physical configuration of a folder, including the folder size, tab size and location, and document label quantities and sizes is first determined. Next, a pattern for printing document labels, tab and folder indicia on the blank folder is designed. The pattern is a general set of printer commands and data customized for a specific application. Once information about a folder and the documents to be contained within are known, the pattern is completed and a specific folder is printed. The folder is then assembled and the printed tab is folded so that the folder identifying indicia are visible from both sides of the folder. Finally, the documents are placed into the folder and the folder is stored.

As part of the filing process, the folder documents can be advantageously scanned as part of the image capture process. To prepare the documents for scanning, a folder is configured with document labels corresponding to each separately identified document. Machine-readable identifying indicia are then printed on each label. During this printing process, a document separator value is printed on a folder panel, identifying the folder to the scanning system as a document separator. The labels are removed and affixed to the first page of each document. All documents associated with a particular folder are then scanned, with the associated folder being scanned last to separate these folder documents from other folder documents. Finally, the scanned documents are placed within the scanned folder and the folder is stored.

BRIEF DESCRIPTION OF THE DRAWINGS

FIG. 2(*b*) is a perspective view of the front side of the preferred embodiment of FIG. 2(*a*).

FIG. 3(*a*) is an exploded view of the label stock and release liner layers of the improved folder.

FIG. 3(*b*) is a plan view of the improved folder before the folder is assembled.

FIG. 3(*c*) is a front view of a series of improved folders configured for continuous tractor-feed printing.

FIG. 3(*d*) is a front view of a series of improved folders configured for single-sheet feed printing.

FIG. 3(*e*) shows the exploded view of the improved folder of FIG. 3(*a*) with an alternate file identification print pattern.

FIGS. 3(*f*) and 3(*g*) show one way in which the folder of FIG. 3(*e*) may be completed.

FIG. 4(*a*) is a perspective view of the improved folder showing the perforation tearing and tab removal steps and the steps for peeling-off the release liner from the tabs to create the preferred embodiment of FIG. 2.

FIG. 4(*b*) is a perspective view of the improved folder showing the folder folding step, the tab folding step and the steps for affixing the tabs to the folder side edges, completing assembly of the preferred embodiment of FIG. 2.

FIG. 4(*c*) is a perspective view of the front side of the preferred embodiment of FIG. 3 alternatively assembled such that the side edges remain unsealed.

FIG. 4(*d*) is a perspective view of the back side of the preferred embodiment of FIG. 4(*c*).

FIG. 4(*e*) is a perspective view showing the alternative folder assembly steps of peeling-off the release liner from the tabs to create the preferred embodiment of FIGS. 4(*c*) and 4(*d*).

FIG. 4(*f*) is a perspective view showing the alternative folder assembly steps of folding the folder and folding the tabs onto themselves, completing the alternative assembly of the preferred embodiment of FIGS. 4(*c*) and 4(*d*).

FIG. 5(*b*) shows another preferred monochrome printing scheme for the improved folder using numeral symbols adjacent to white, gray and black backgrounds and bars.

FIG. 5(*c*) shows another preferred monochrome printing scheme for the improved folder using bar codes.

FIG. 8(*b*) is a color-wheel illustrating a color-encoding scheme for translating a colored tab to alphabetic groups.

FIG. 9(*a*) is a perspective view of the front side of this alternative embodiment, showing the side edges sealed by a printed, integrated tab at one side edge and an unprinted, integrated tab at the other side edge.

FIG. 9(*b*) is a perspective view of the back side of this alternative embodiment.

FIG. 9(*c*) is an exploded view of the three layers of this alternative embodiment the improved folder.

FIG. 9(*d*) is a perspective view of this alternative embodiment with the front and back panels attached along their bottom edges and in an fully opened position for printing.

FIG. 9(*e*) is a detailed view of the attachment point of the front and back panels of this alternative embodiment.

FIG. 9(*f*) is a front view of a series of this alternative embodiment of the improved folder, configured for continuous tractor-feed printing.

FIG. 9(*g*) is a front view of a series of this alternative embodiment of the improved folder configured for single-sheet feed printing.

FIG. 11(*b*) is a perspective view of the third embodiment of the improved folder when assembled.

FIG. 12(*b*) is a perspective view of the fourth embodiment of the improved folder when assembled.

FIG. 13(*b*) is an information flow diagram of the preferred folder printing system.

DETAILED DESCRIPTION OF THE INVENTION

Figure 1:
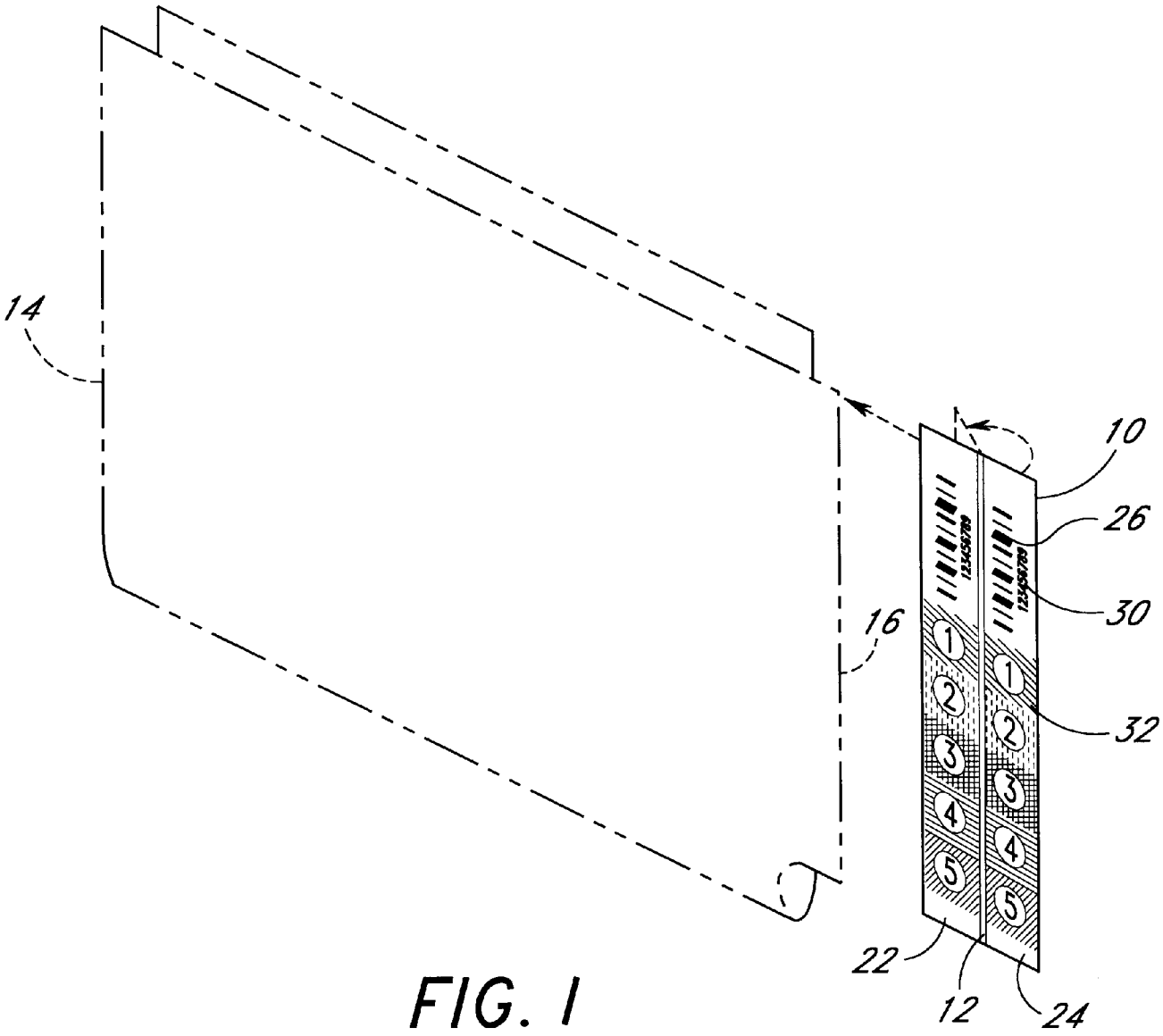
FIG. 1 is a perspective view of a conventional folder label which must be manually folded and applied to the tab end of a conventional folder.

As shown in FIG. 1, a conventional label 10 can be folded at its mid-point 12 and manually applied to a conventional folder 14 on the folder tab 16. The label is adhesive-backed so that it adheres to the tab. The label is printed with indicia which serve to identify a specific folder. Duplicative indicia are printed on the label front portion 22 and the label back portion 24 to be readily seen from either side of the folder. The typical folder identification scheme employed on these labels utilizes a combination of machine-recognizable indicia, text and color blocks. The color blocks provide visual cues for quickly identifying folder groups and possibly specific folders within a group. For example, FIG. 1 shows bar code 26 and text 30 identifying this folder as "123456789." Unique color blocks 32 associated with each numeral of the first five folder digits are also printed on the label in this example. For example "1" is green, "2" is violet, "3" is yellow, "4" is blue and "5" is brown. Thus, this folder can be readily identified with the folder group "12345xxxx."

Figure 2B:
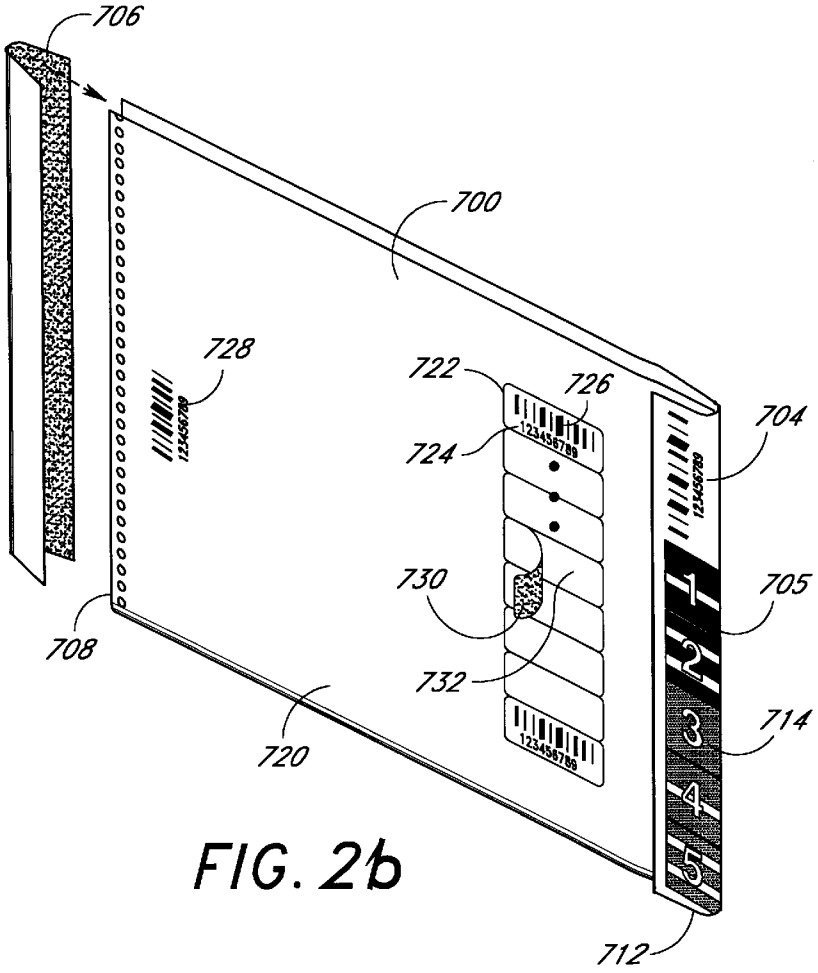
FIG. 2(*a*) is a perspective view of the back side of a preferred embodiment of the improved folder according to the present invention.
Figure 2A:
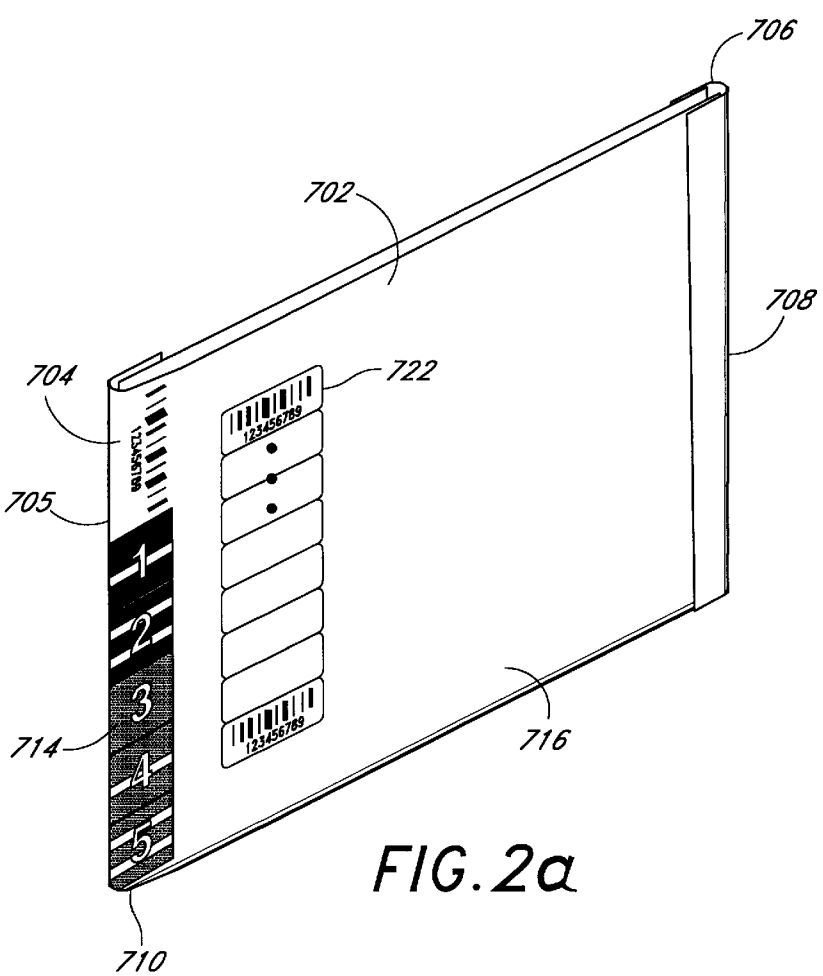
Figure 3A:
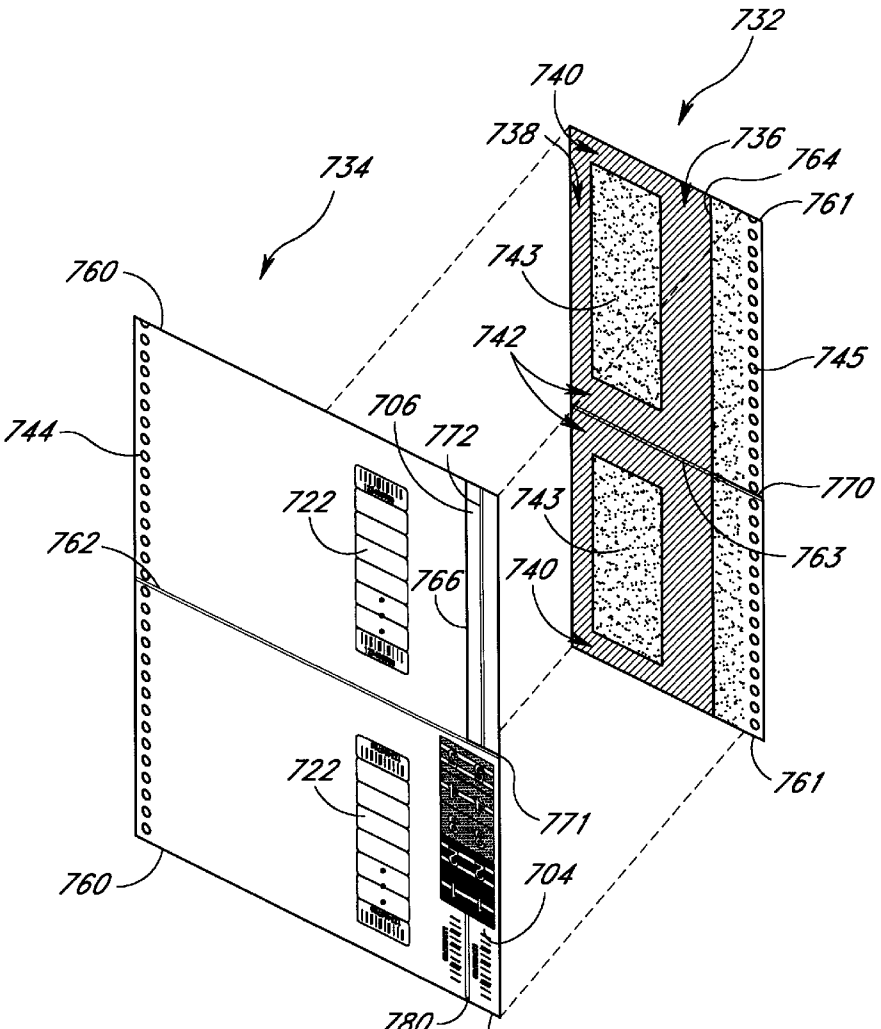
FIGS. 3 show the construction of the preferred embodiment of FIG. 2.
Figure 3B:
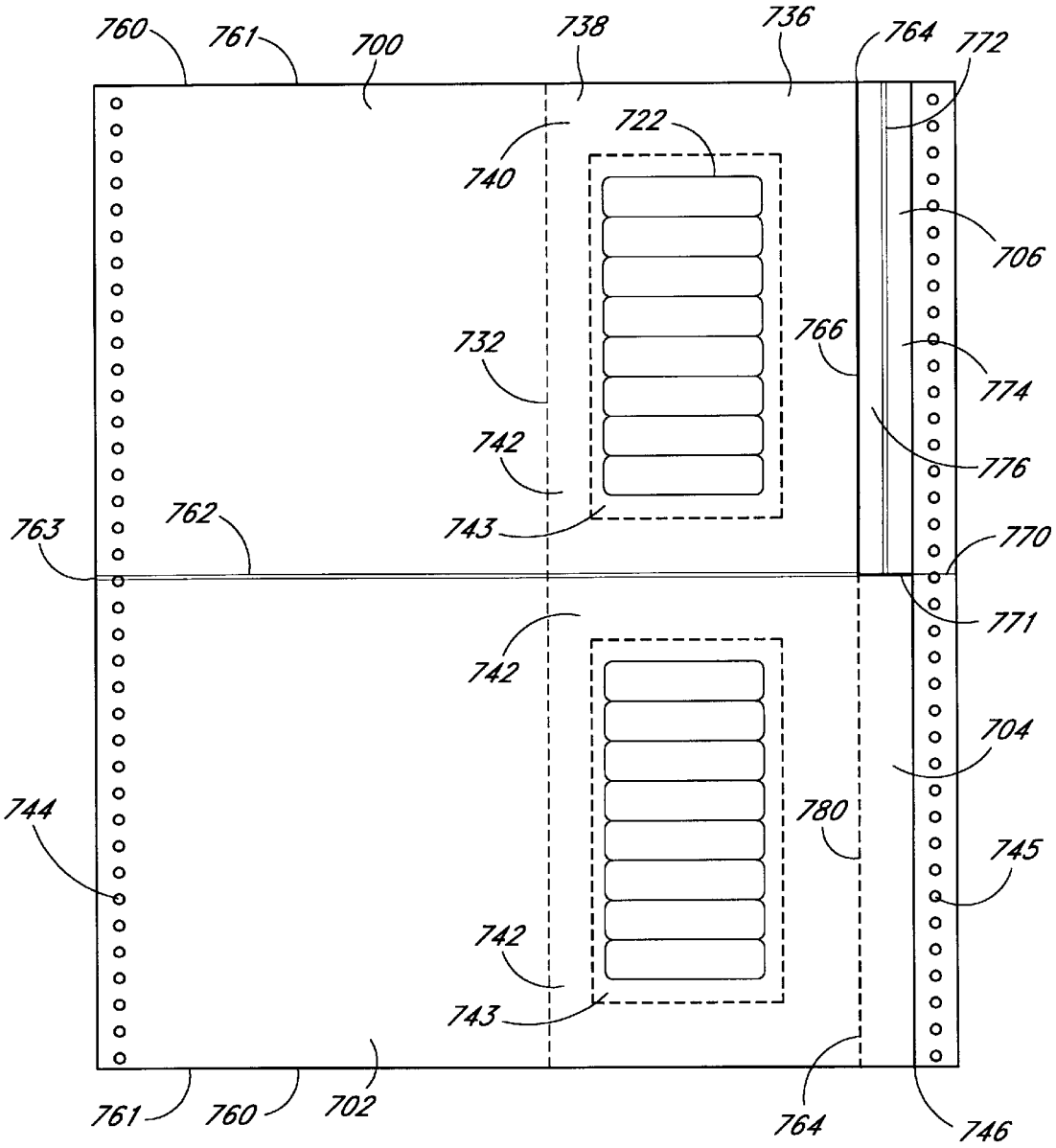
Figure 3C:
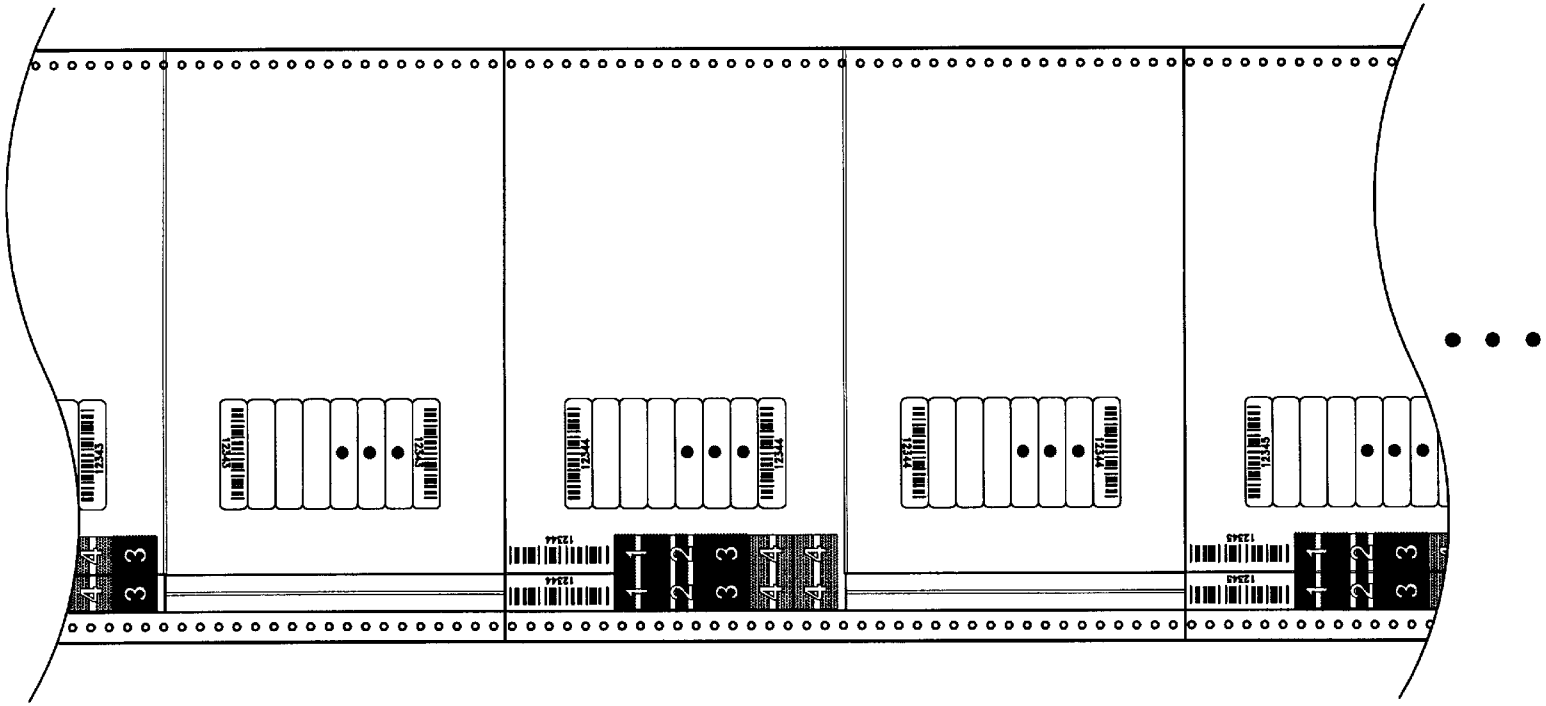
Figure 3E:
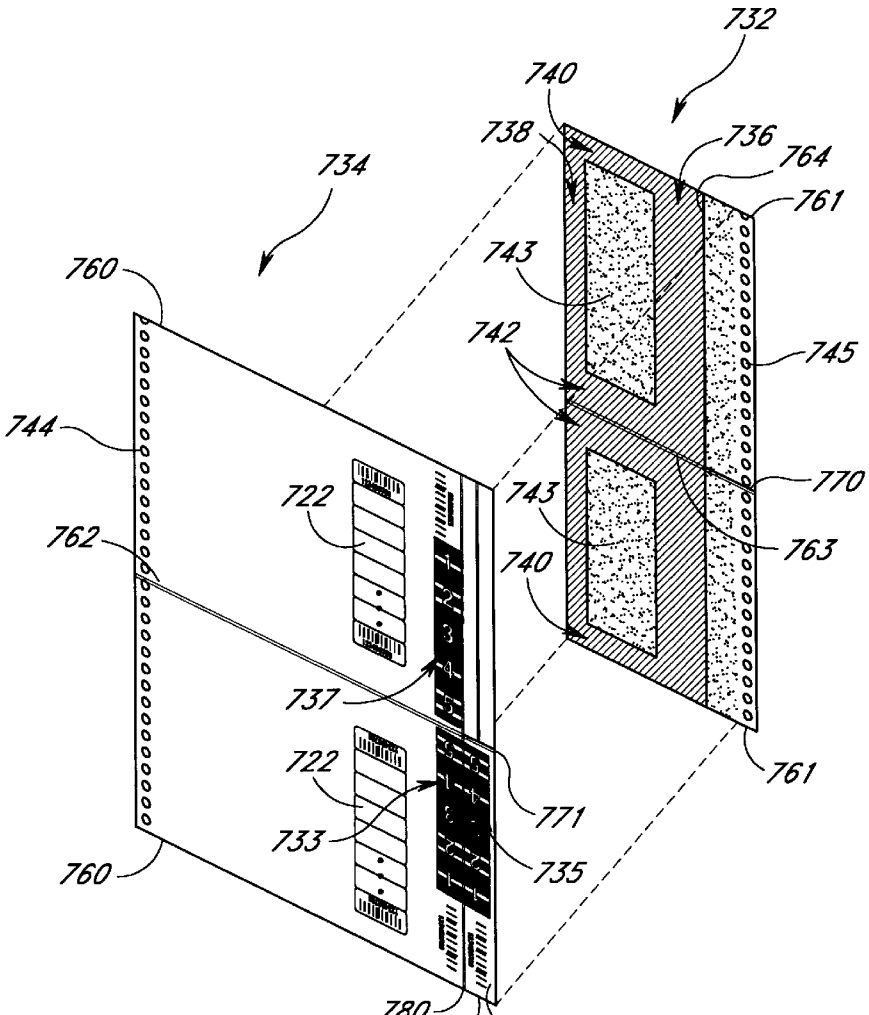
Figure 3G:
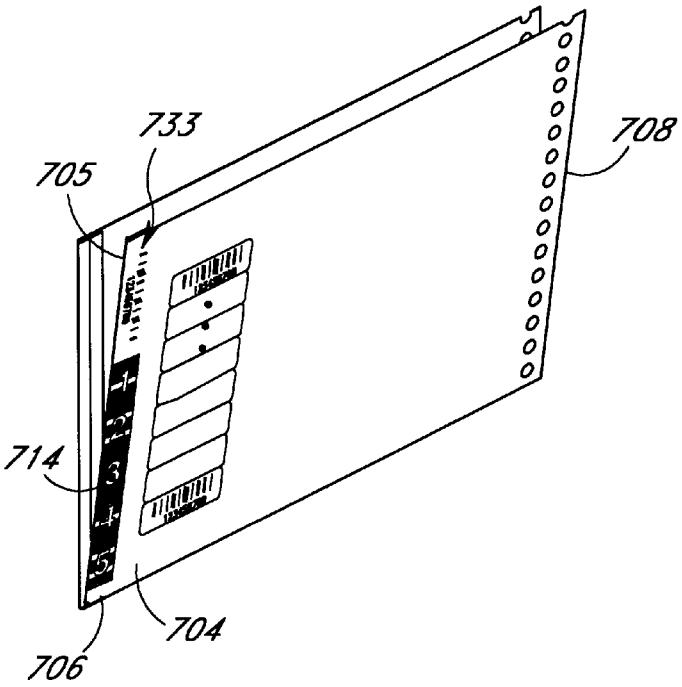
Figure 3F:
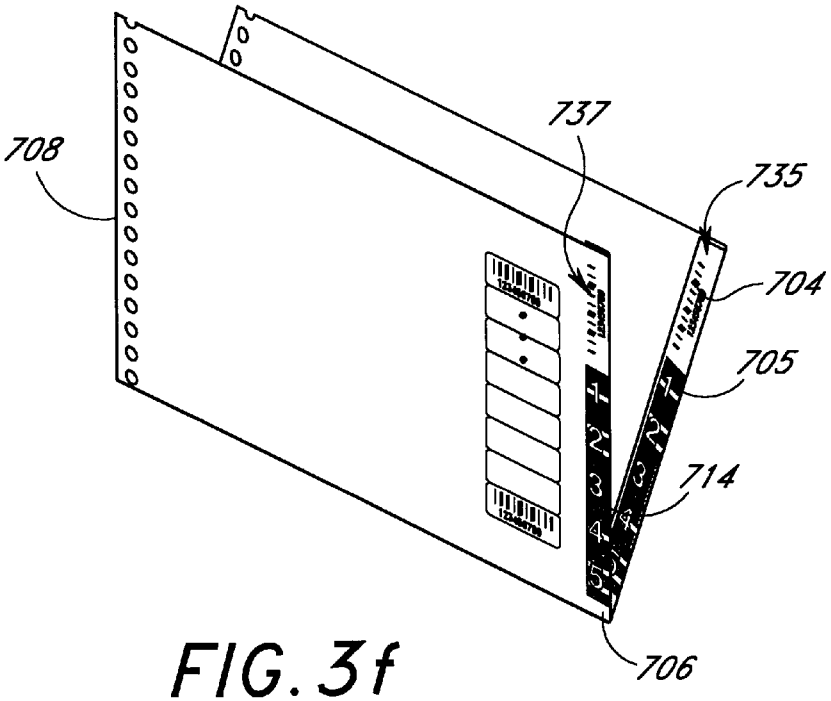
Figure 4B:
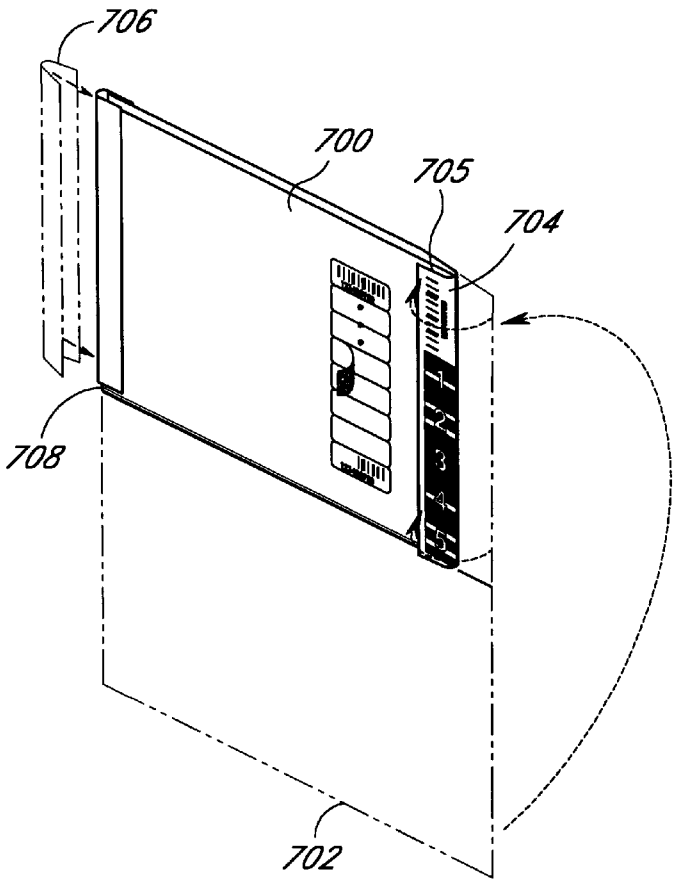
FIG. 4 show the assembly of the preferred embodiment of FIG. 3 and an alternative assembly of the preferred embodiment of FIGS. 3.
Figure 4A:
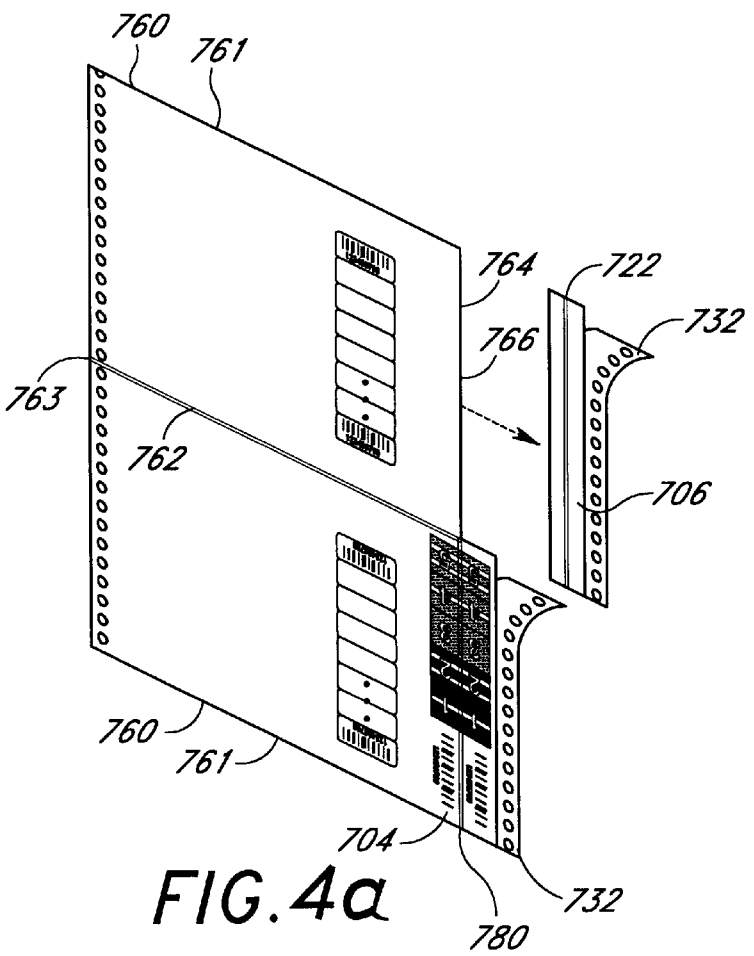
Figure 4D:
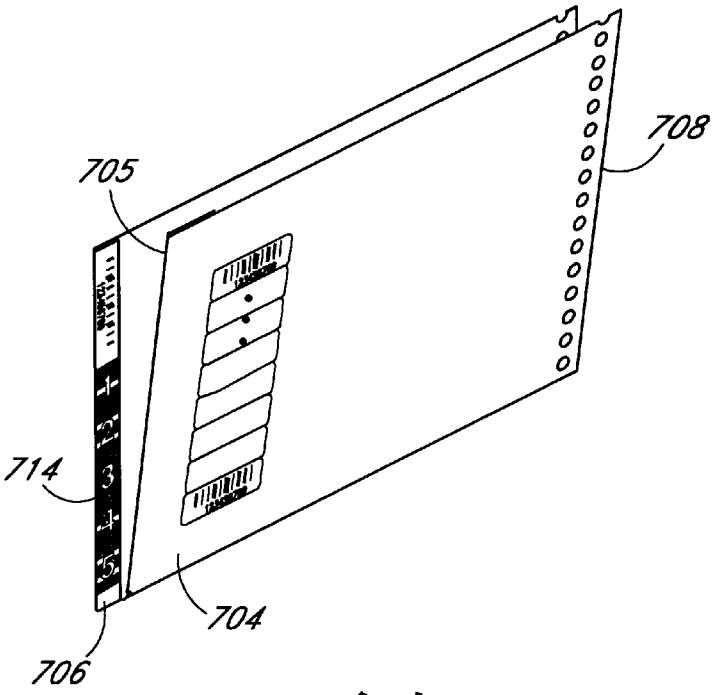
Figure 4C:
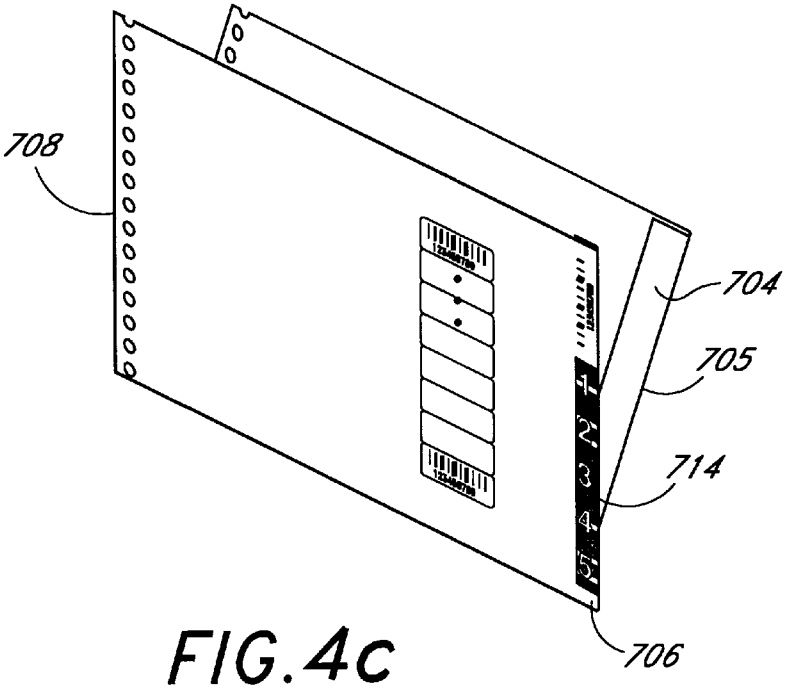
Figure 4F:
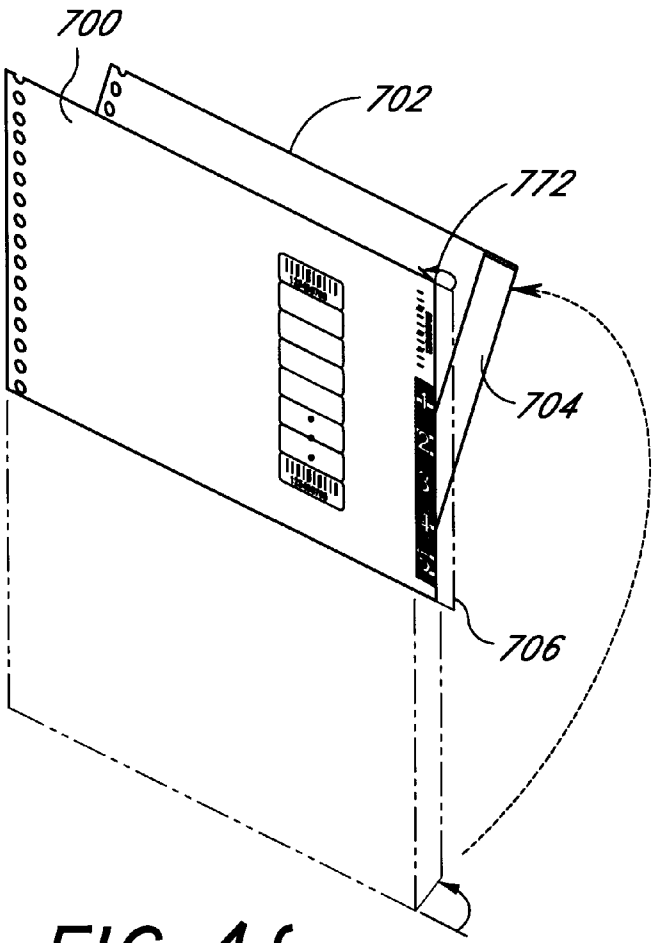
Figure 4E:
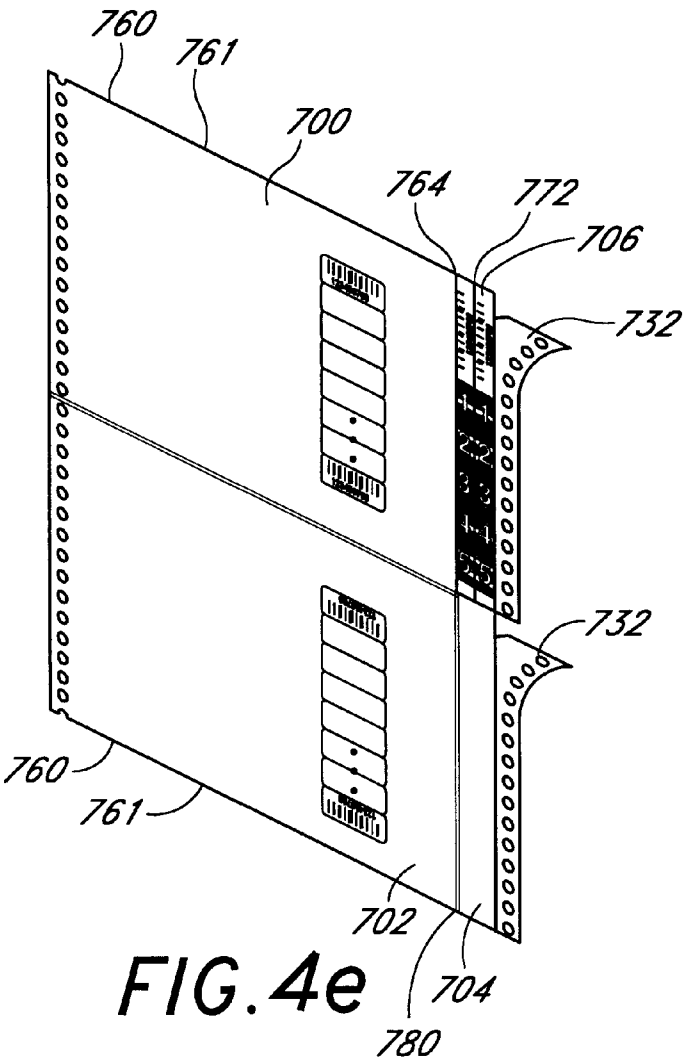

As shown in FIGS. 2(*a*) and (*b*), a preferred embodiment of the improved folder of the present invention has a front panel 700, a back panel 702 and an integrated tab 704 which seals one side 705 of the folder. The folder also has a removable tab 706, which seals the other side 708 of the folder. The integrated tab 704 is an extended portion of the back panel 702. The folder's side and bottom edges form a pocket in which documents can be held awaiting image scanning or stored post image scanning. Sealing the folder along three edges in this manner advantageously provides increased stability to the folder. In the alternative, one side edge 708 of the folder can also remain unsealed, allowing documents to be inserted into the folder from either the side or the top.

During folder assembly, the integrated tab 704 is folded over a folder edge 705 and affixed to the front panel 700 so as to seal that side edge 705 of the folder. The integrated tab 704 has a back portion 710 and a front portion 712 where duplicative tab indicia 714 are printed. Indicia on the back tab portion 710 are visible from the back side 716 of the assembled folder and indicia on the front tab portion 712 are visible from the front side 720 of the folder. Thus, this integrated folder tab 704 performs the same role as the manually folded and applied conventional label 10 shown in FIG. 1. Because the tab of the improved folder is an integral part of the folder, however, the labor intensive and error prone task of manually labeling a conventional folder tab is eliminated. The task of matching separately printed labels to folders is also eliminated. Letter-sized folders, (which contain 8½"×11" documents) are 9"×12¼" when assembled. Legal-sized folders, (which contain 8½"×14" documents) are 9"×14⅞" when assembled.

Integrated document labels 722 on the front panel 700 and back panel 702 are printed with text 724 and machine-recognizable indicia 726, such as bar codes or OCR fonts. A document separator value 728 is also printed on the front panel 700. The labels have an adhesive backing 730 and can be peeled from a release liner 732 and affixed to folder documents, allowing the documents to be readily identified by a bar code collection device, an image scanner or an individual. The document separator value 728 allows the folder itself to be recognized during document scanning as the item which separates the documents stored in that folder from the documents stored in other folders. The document separator value is advantageously represented by a bar code printed at a specific location on a folder panel. The document separator value can be a null value that does not correspond to any folder or document identifier, for example alternating 1's and 0's. Alternatively, the folder identifier or similar identifier can advantageously be used as the document separator value, thereby imparting information to the scanning system regarding the next document set to be scanned prior to scanning the first document of that set. Thus, in this embodiment, each folder would have a different document separator value. The specific location of the document separator value is known to the scanning equipment and during the scanning process the equipment will look for the separator value at that location. The document scanning process is described in detail below. The integrated tab 704, document labels 722, document separator value 728 and other portions of the panels are printed at the same time and by the same printing process.

The document labels 722 also provide a built-in element verification method. Because only those document labels which are needed for a particular folder are printed, any remaining labels on a panel provide an instant visual indication of which documents have yet to be placed into, or matched to, the folder. Further, the panel area adjacent each document label can be printed with the document label indicia, providing a convenient list of documents placed in the folder. This list can be visually-read or machine-read with a scanner or a bar code wand for auditing purposes. A further advantage of integrated document labels is that the process of matching separately printed document labels with the folder containing the document is eliminated.

FIG. 3(*a*) shows the construction of the preferred embodiment of FIG. 2. The folder is constructed from release liner material 732 attached to paper or card stock (hereinafter "label stock") 734 with pressure-sensitive adhesive, in the manner described in U.S. Pat. No. 5,129,682 and No. 5,271,787. The label stock 734 currently ranges from 7.5 mil, 75 pound Hi-Bulk paper to 9.5 mil, 125 pound Tag paper. This stock is thick enough to provide support for the folder, but thin enough to be accepted by standard printers and scanners. The release liner is formed by coating a web ply with a release material, such as silicon. A coat of pressure sensitive adhesive is then applied to the web and the twice-coated web, which is the release liner 732 is then applied to the label stock 734. The combined label stock 734 and release liner 732 is processed as a continuous roll of folder material to create a series of interconnected folders as shown in FIG. 3(*c*). The silicon coating is applied to the web in a pattern which omits the release coating from longitudinal sections 736, 738 (i.e. sections parallel to the length of the roll of folder material) and transverse sections 740, 742 (i.e. sections perpendicular to the length of the roll of folder material). These sections form a perimeter of "frozen liner" 743 which does not release from the label stock. The label stock 734 is then die cut within the frozen liner perimeter 743 to create releasable integrated document labels 722. Perforations are made in the label stock 760, 766 and liner 761, 764 to create tear lines to separate individual folders from the continuous roll of folder material and to allow separation of the removable tab 706 from each individual folder. Additional perforations are made in the label stock 762, 772, 780 and liner 763 to create fold lines for the integrated tab 704, removable tab 706 and for the folder. These perforations are discussed in more detail below with respect to FIG. 3(*b*). Also, tractor-feed holes 744, 745 are punched at the sides of the roll of folder material. The tractor-feed holes allow the folder material to be continuously feed into a high-speed printer. After printing, the folders are assembled by being separated, folded and sealed as described below. Alternatively, the folders can be constructed with no tractor-feed holes and processed as single-sheets for use with page fed printers, as illustrated in FIG. 3(*d*).

FIGS. 3(*e*), (*g*) and (*f*) show an alternative preferred embodiment of the print pattern used for the file identification symbology. As can be seen in FIGS. 3(*e*), (*g*) and (*f*), the pattern on the right-hand side includes first and second identical file identification symbology sets 733, 735 which are substantially the same so that the file identification can be seen on both sides of the tab when the tab is folded over. A third substantially identical file identification symbology set 737 is advantageously placed on the right-hand side of the front panel, spaced in from the edge so that it is directly above the first set. This permits easy viewing of the file identification set from both sides of the folder when the completed folder is made with an open right-hand side as shown in FIGS. 3(*g*) and (*f*). It is contemplated that this concept could be advantageously used on any of the edges of the folder. Note that where the alphanumerics are not incorporated into the coded pattern (see FIG. 5 for example), the alphanumerics may be on different sides of the patterns in each substantially identical symbology set as may be desired from an aesthetic point of view.

FIG. 3(*b*) shows the detailed construction of the preferred embodiment of FIG. 2 before it is assembled, with the folder front panel 700 and back panel 702 spread apart. The release liner 732 is advantageously 6¼" wide and extends the entire length of the folder. The release liner 732 extends beyond the edge of the label stock 746 on the folder right-side by ⅜", that ⅜" portion containing tractor-feed holes 745. The frozen liner perimeter 743 on each folder panel is made up of a ½" longitudinal section 738, a 1⅝" longitudinal section 736, a 1½" transverse section 742 and a 1 5/16" transverse section 740. Eleven 9/16"3" labels 722 are die-cut within this perimeter, creating 22 total labels for each folder, 11 on the front panel 700 and 11 on the back panel 702.

Three types of perforations are created in the label stock and the liner: a perforation known in the art as an "easy" perforation which can easily be torn; a perforation known in the art as a "fold" perforation which is a very crude perforation that does not tear easily but allows the material to be easily folded; and a "slit," which completely separates the material on either side of the slit.

A line transverse easy perforation 761 and a label stock transverse easy perforation 760 are made at the boundaries separating each folder, allowing individual folders to be separated from the continuous roll of folder material. A liner transverse fold perforation 763 and a label stock transverse fold perforation 762 are made in the middle of the folder material, allowing the folder to be folded in half to create a front and a back panel.

Several perforations create a removable tab on each folder. A liner longitudinal easy perforation 764 is made in the entire 18" length of the liner 1⅛" from the liner right edge. A label stock longitudinal easy perforation 766 is also made in the top 9" of the label stock in the corresponding location as the liner longitudinal easy perforation 764. In the middle of the folder, a 1⅛" liner transverse slit 770 is made extending from the liner longitudinal liner easy perforation 764 to the edge of the liner. A ¾" label stock transverse slit 771 is made extending from the label stock longitudinal easy perforation 766 to the label stock edge 746. These perforations allow the removable tab 706, which is the top, right ¾"×9" folder section, to be completely removed. A 9" longitudinal fold perforation 772 is made in the label stock ½" from the label stock edge 746, allowing the removable tab 706 to be folded lengthwise. Because the removable tab 706 is ¾" wide, this longitudinal fold perforation 772 creates a ½" wide tab portion 774 and a ¼" wide tab portion 776. This asymmetry allows the ½" wide tab portion 774 to reinforce the label stock longitudinal easy perforation 766 when the folder is alternatively assembled with the removable tab folded onto itself, as described below in conjunction with FIGS. 4(*c*)–(*f*).

Other perforations create an integrated tab 704, which is the bottom, right 1½"×9" folder section. A longitudinal fold perforation 780 is made in the bottom 9" of the label stock corresponding to the bottom 9" of the liner longitudinal easy perforation 764 described above. The transverse slit 771 described above separates the integrated tab 704 from the removable tab 706. Once the liner is removed from the back of the integrated tab 704, it can be folded at the fold perforation 780.

FIGS. 4(*a*) and 4(*b*) show the initial steps for assembling the preferred embodiment of the improved folder of FIG. 2. In step 1, a folder is separated from adjacent folders by tearing the co-located label stock transverse easy perforation 760 and liner transverse easy perforation 761 at the folder boundaries. In step 2, the removable tab 706 is separated from the folder by tearing the co-located label longitudinal easy perforation 766 and liner longitudinal easy perforation 764 from the top 9" of the unassembled folder form to the transverse slit 770. The separated removable tab 706 is then set aside for step 6. For step 3, the folder is folded in half at the co-located label stock transverse fold perforation 762 and liner transverse fold perforation 763 in the middle of the folder. In step 4, the release liner 732 is peeled from the integrated tab 704, exposing the adhesive on the back of the integrated tab label stock. In step 5, the integrated tab 704 is folded from the back panel 702 to the front panel 700 along the label stock longitudinal fold perforation 780, sealing the right edge 705 of the folder. For step 6, the release liner 732 is peeled from the removable tab 706 separated and set aside in step 2, exposing adhesive on the back of the removable tab label stock. In step 7, the removable tab 706 is folded at the label stock longitudinal fold perforation 722. Finally, in step 8, the removable tab 706 is affixed to the front panel 700 and back panel 702, sealing the left edge 708 of the folder. At this point, the folder is completely assembled.

FIGS. 4(*c*) and 4(*d*) show the preferred embodiment of the improved folder of FIG. 3 alternatively assembled, as compared with FIG. 2, such that the folder sides 705, 708 are unsealed, the integrated tab 704 is folded out-of-sight to the inside of the folder, and the removable tab 706 is not removed but folded onto itself to form a protruding folder side tab. If the folder is assembled in this fashion, the tab indicia 714 are printed on the removable tab 706 and not the integrated tab 704.

Referring to FIGS. 4(*e*) and 4(*f*), the improved folder can alternatively be assembled in five steps. In step 1, the folder is separated from adjacent folders by tearing the colocated label stock transverse easy perforation 760 and liner transverse easy perforation 761 at the folder boundaries. In step 2, the liner 732 is peeled-off the removable tab 706 to expose the adhesive on the back of the removable tab label stock. In step 3, the removable tab 706 is folded onto itself along the label stock longitudinal fold perforation 772, creating a protruding label. Because of the position of this fold perforation on the removable tab, when the tab is folded onto itself, ¼" of the tab overlaps the label stock longitudinal easy perforation 764. This reinforces that easy perforation, preventing the removable tab 706 from tearing off the folder. This leaves a ¼" width print area on the removable tab for tab indicia. In step 4, the liner 732 is peeled-off the integrated tab 704 to expose the adhesive on the back of the integrated tab label stock. Finally, in step 5, the integrated tab 704 is folded onto the inside of the back panel along the label stock longitudinal fold perforation 780.

Figure 5A:
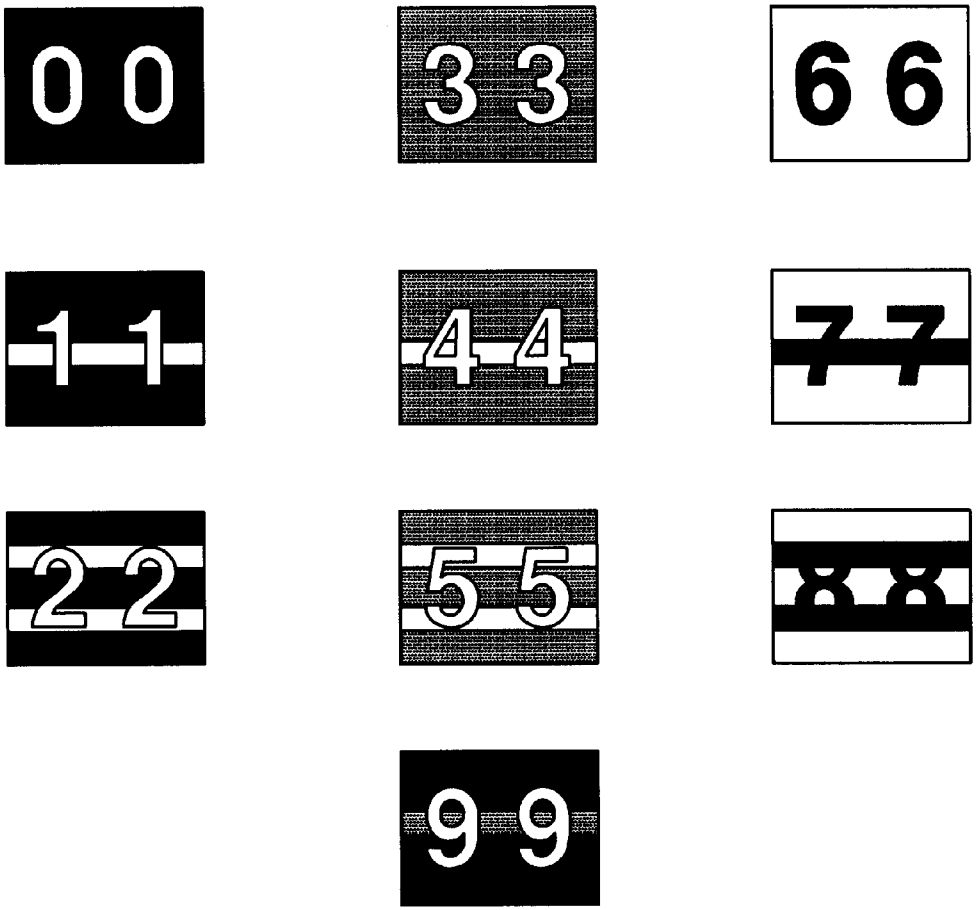
FIG. 5(*a*) shows a preferred monochrome printing scheme for the improved folder using white and black numeral symbols superimposed on white, gray and black backgrounds and bars.
Figure 5B:
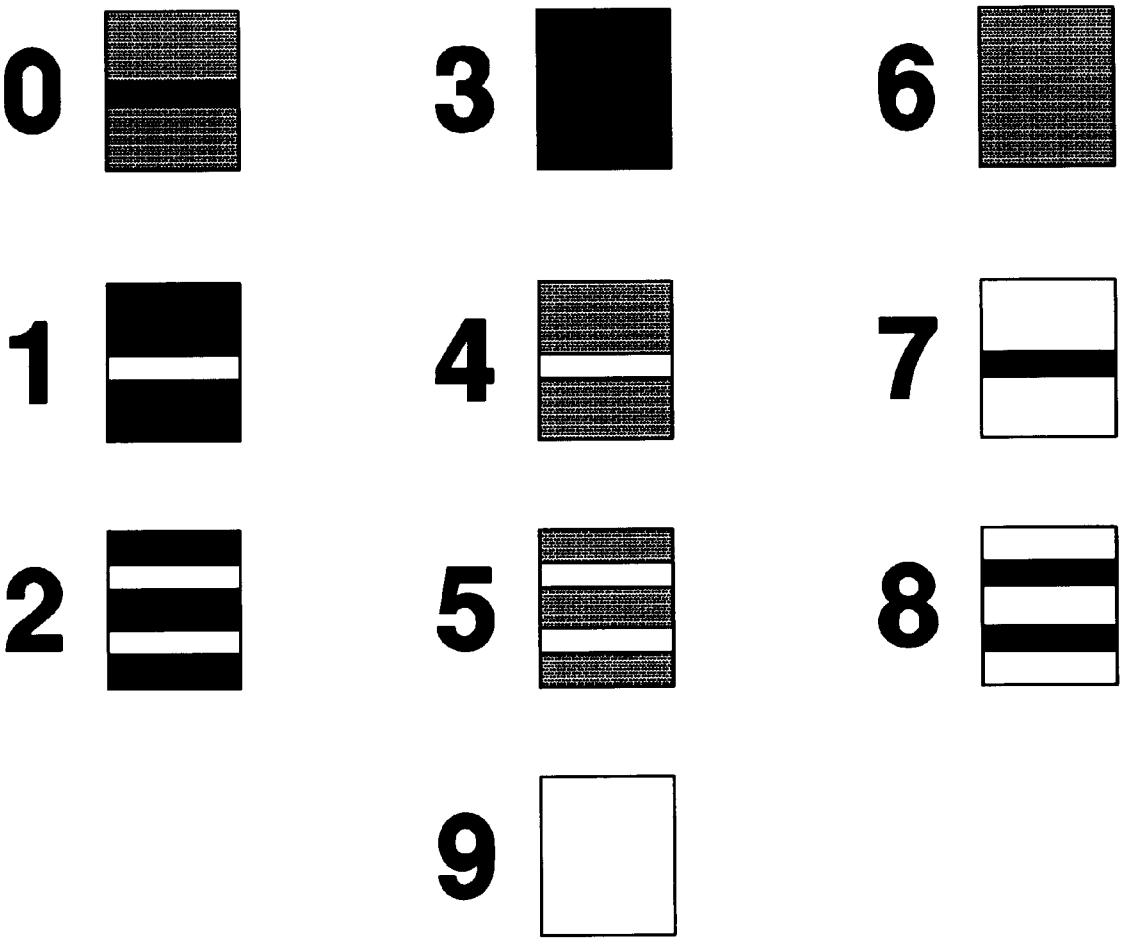
Figure 5C:
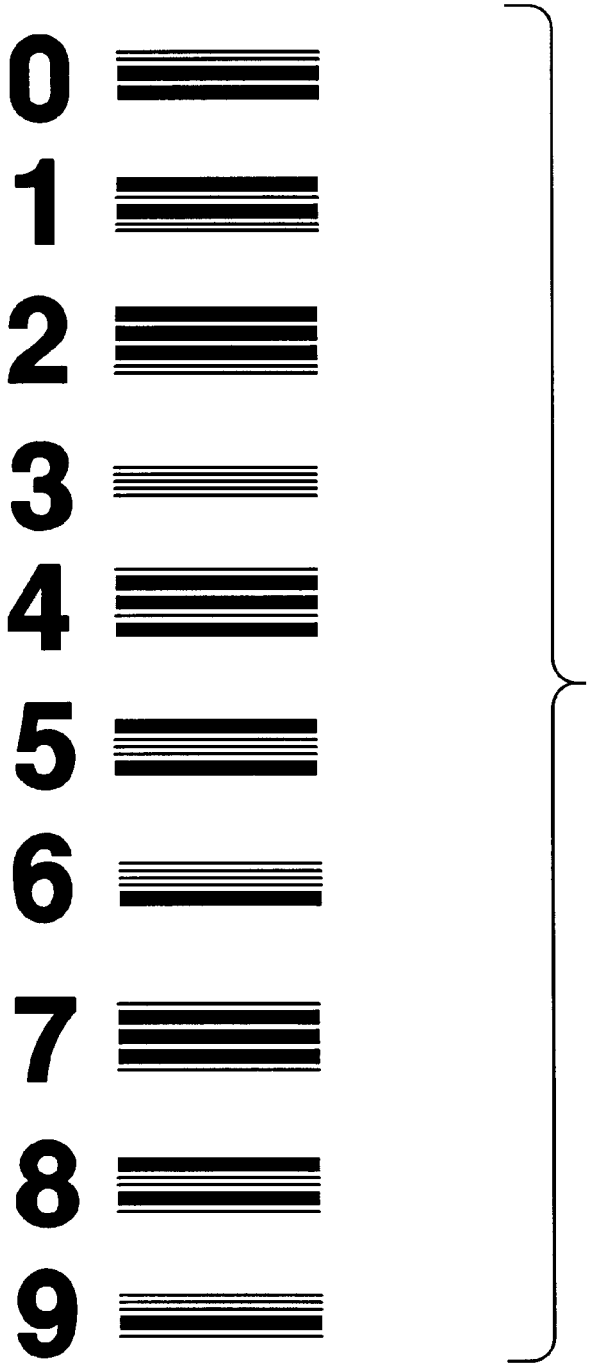

FIGS. 5(*a*),(*b*) and (*c*) show some preferred monochrome tab indicia for folder identification. Because color printers are slower than monochrome printers, monochrome tab indicia can be advantageously utilized to achieve faster printing throughput for the folders than if color tab indicia are used. Also, high contrast indicia are advantageously utilized for quick folder identification. The indicia shown in FIGS. 5(*a*) and (*b*) use a scheme of high contrast backgrounds and bars to ease indicia recognition. In the tab indicia embodiment shown in FIG. 5(*a*), the numbers "0", "1" and "2" are represented as white numbers on a black background; the numbers "3", "4" and "5" are represented as white numbers on a gray background; and the numbers "6", "7" and "8" are represented as black numbers on a white background. Zero, one or two horizontal stripes which contrast with the background are used to distinguish each number in the groups of three described above. The remaining number, "9", is represented as a white number on a black background with a single horizontal gray stripe. Different grouping of numbers can be likewise represented. For example, an alternative scheme would represent the numbers "1", "2" and "3" as white numbers on a black background; the numbers "4", "5" and "6" as white numbers on a gray background; and the numbers "7", "8" and "9" as black numbers on a white background. The remaining number, "0", is then represented as a white number on a black background with a single horizontal gray stripe. FIG. 5(*b*) shows another preferred tab indicia embodiment similar to that of FIG. 5(*a*), but with adjacent numeral symbology and a slightly different background and bar scheme. FIG. 5(*c*) is yet another preferred tab indicia embodiment advantageously using bar codes as high contrast and readily visible tab indicia for folder identification. Another alternative tab indicia embodiment utilizing monochrome printing advantageously uses blocks of highly visible monochrome patterns, such as checkerboards, cross-hatching, vertical and horizontal bars, large dots, X's, etc. It is contemplated that all of the monochrome tab indicia could also be advantageously color coded such that the unique pattern corresponding to each alphanumeric is printed in a color which is also unique to the alphanumeric.

Figure 6:
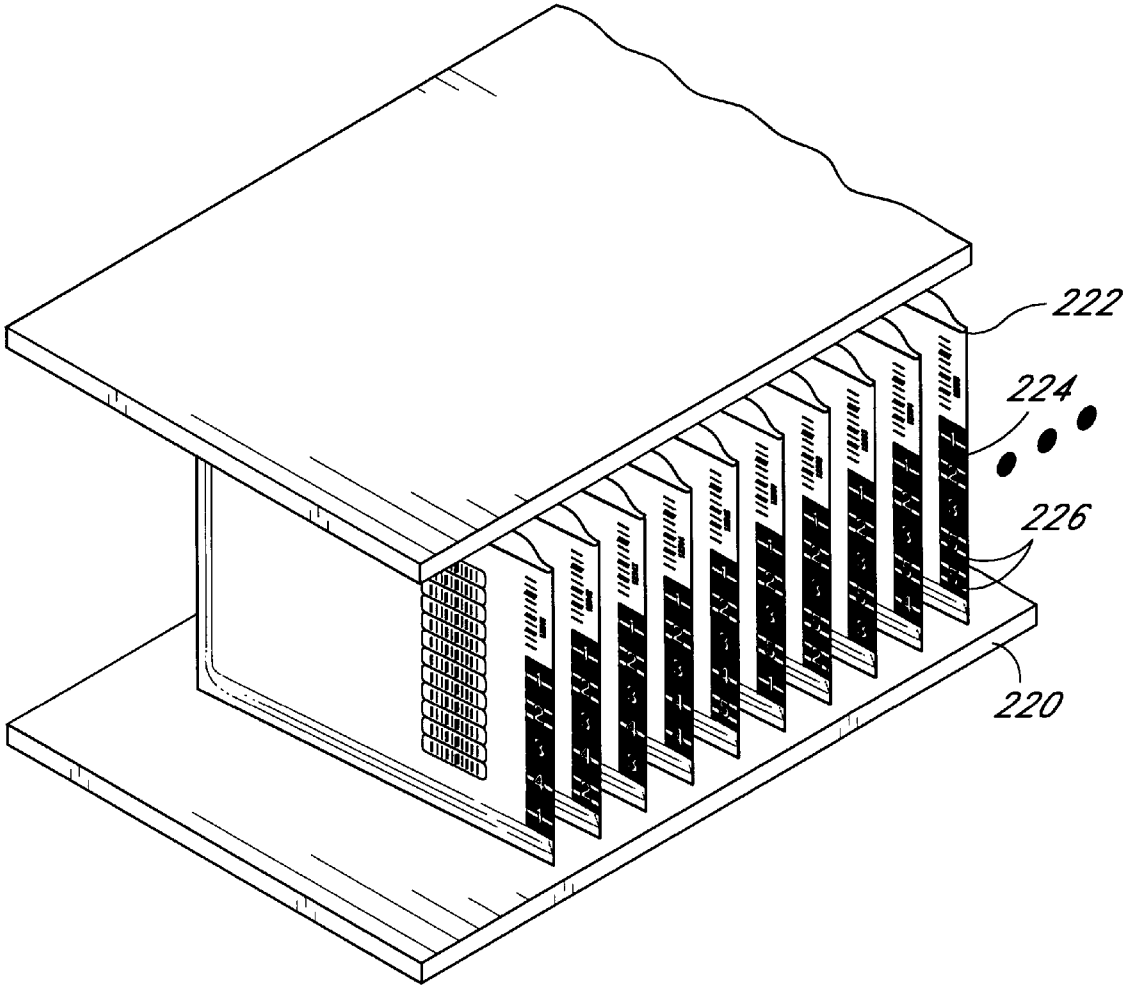
FIG. 6 is a perspective view of the improved folders on a shelf showing the visible tab indicia for folder identification.
Figure 10:
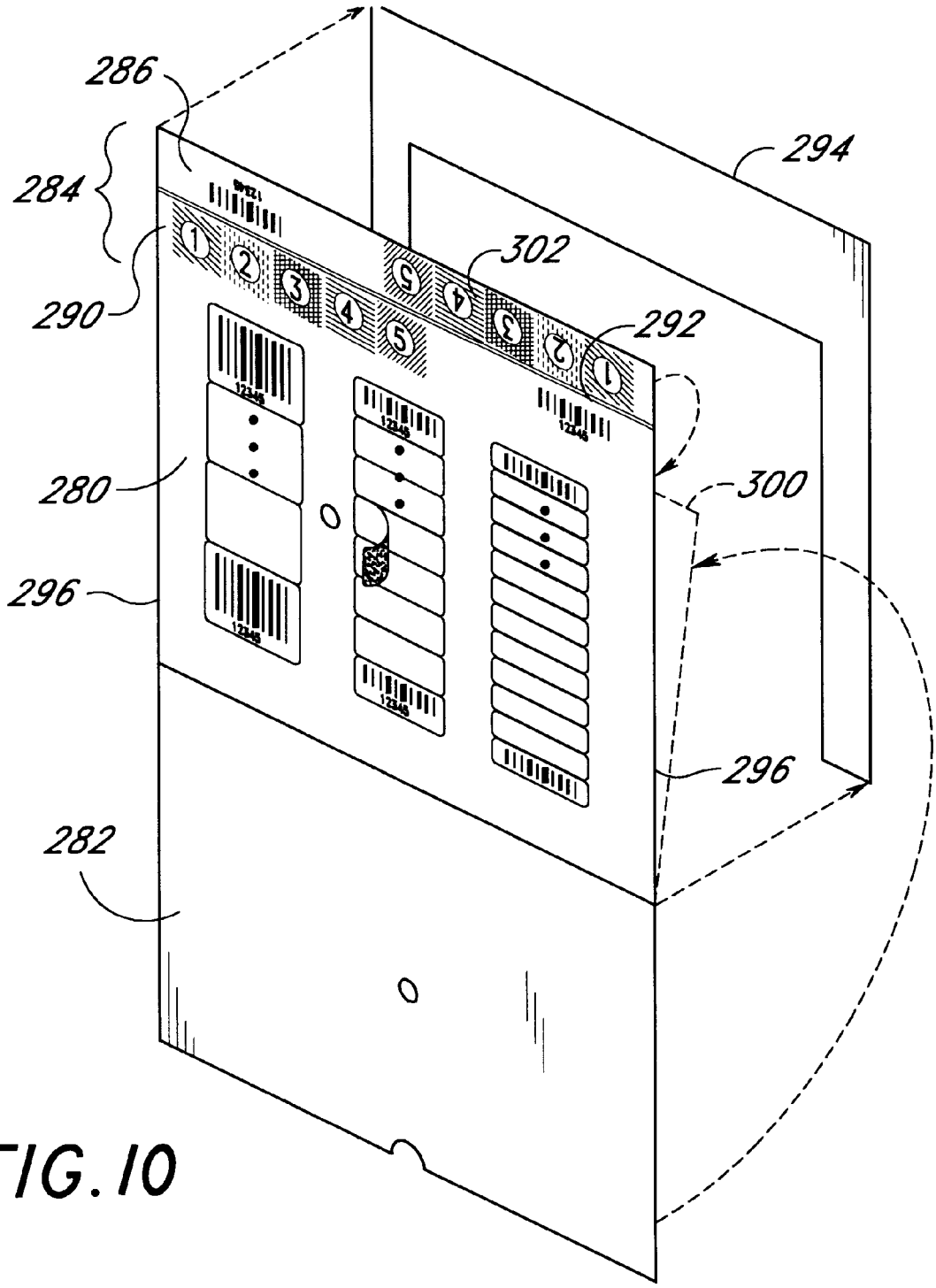
FIG. 10 shows a perspective view of a second embodiment of the improved folder according to the present invention, where the folder has a top tab which folds back upon itself and has panels which are sealed by the adhesive remaining after the release liner is removed.

Referring to FIG. 6, a preferred embodiment of the improved folder is schematically shown stored on a shelf with other such folders. The folder end tabs and the tab indicia are visible at a glance. Similarly, when folders are stored in a container such as a drawer, folder top tabs would be utilized and these top tabs and the tab indicia would be visible at a glance. An embodiment of the improved folder incorporating top tabs is shown in FIG. 10. Referring again to FIG. 6, the number blocks 224, allow these folders to be quickly identified as belonging to the "123" group of folders. If a misplaced folder belonging to another group is placed among these folders, it would be readily noticed. In this example, individual folders are identified by the last two digits 226 on the folder tabs 222. The individual folders in the "123" group are "41," "42," "43," "44," "45," "51," "52," "53," "54" and "55."

Figure 7:
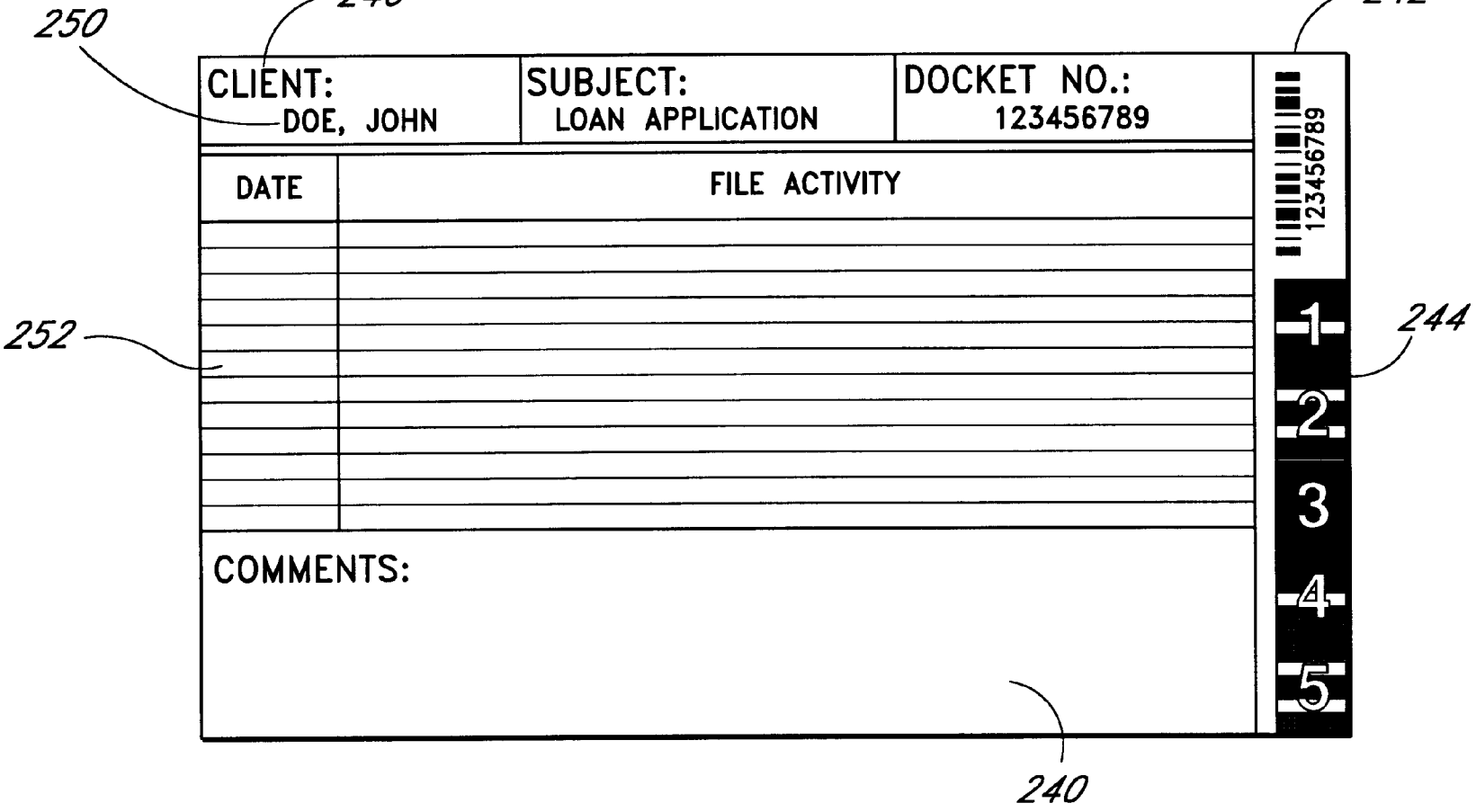
FIG. 7 is a front view of the preferred embodiment of the improved folder showing the folder front panel alternatively pre-printed with categories for handwritten indicia and the tab alternatively printed with color indicia.

Shown in FIG. 7 are alternative color indicia printed on the front panel 240 of a preferred embodiment of the improved folder. FIG. 7 also illustrates that the front panel 240 can be printed with folder identifying text. As an example, a folder identifying form 246 can be advantageously printed on the folder showing categories such as "CLIENT," "SUBJECT," and "FILE NO." Unlike a preprinted folder, however, folder specific text 250, such as a specific name can also be printed into the form 246 at the same time the form itself is printed. This eliminates the need to manually label each folder. These categories 252, however, can also be left blank to be handwritten or labeled at a future time.

Figure 8B:
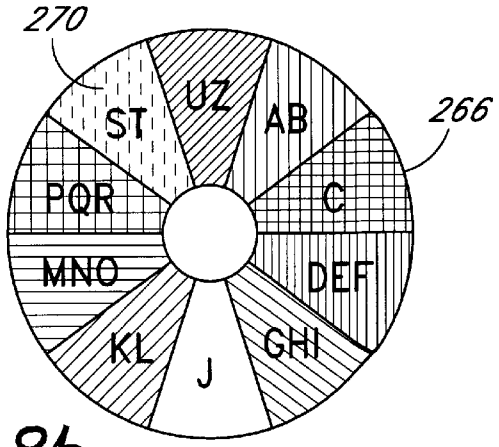
FIG. 8(*a*) is a front view of the preferred embodiment of the improved folder showing the tab alternatively printed with colored-tab and position block indicia.
Figure 8A:
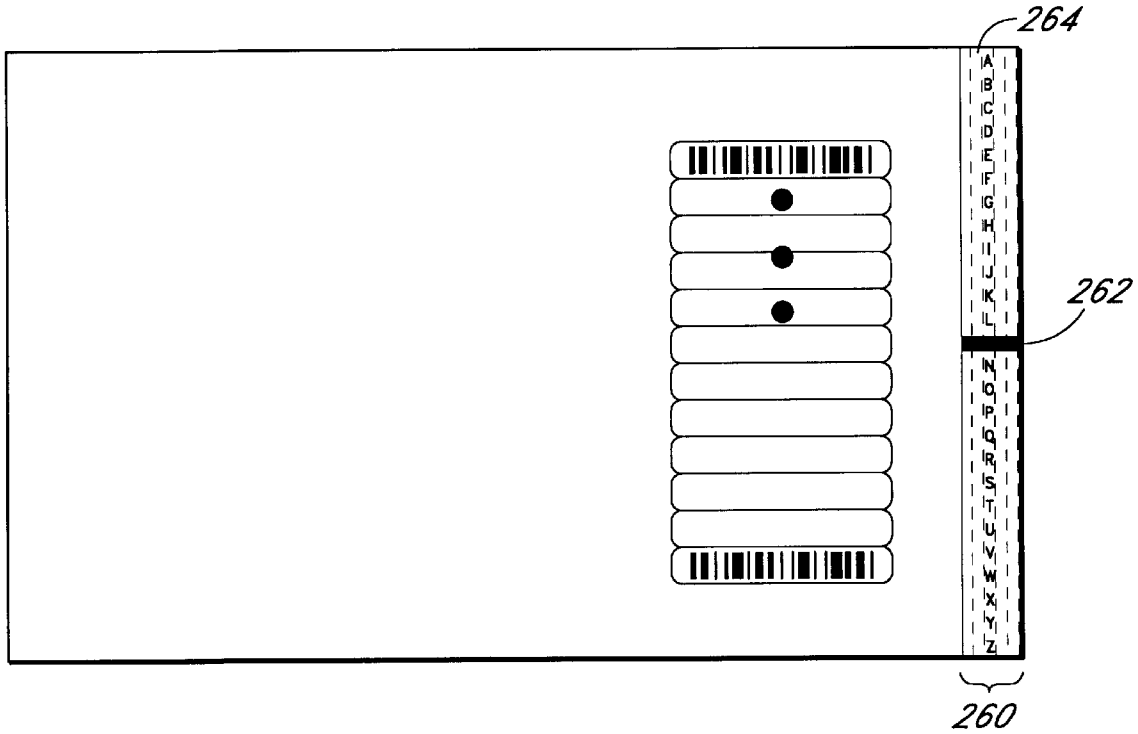
Figure 9B:
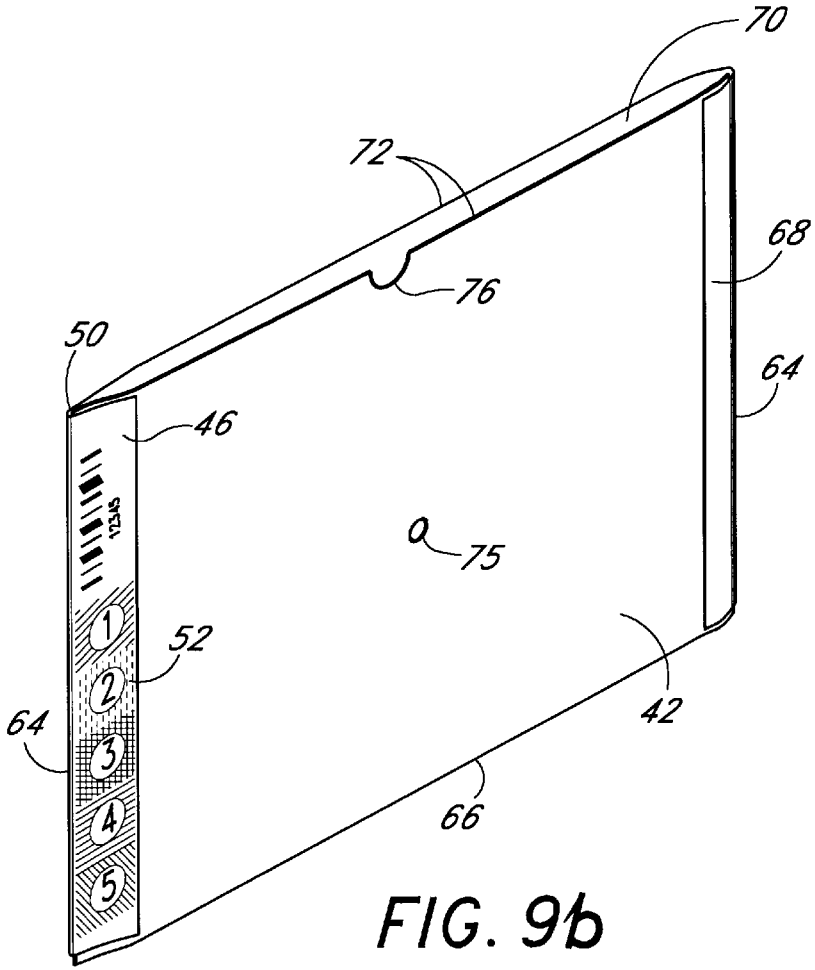
FIG. 9 show construction and assembly of a first alternative embodiment of the improved folder according to the present invention.
Figure 9A:
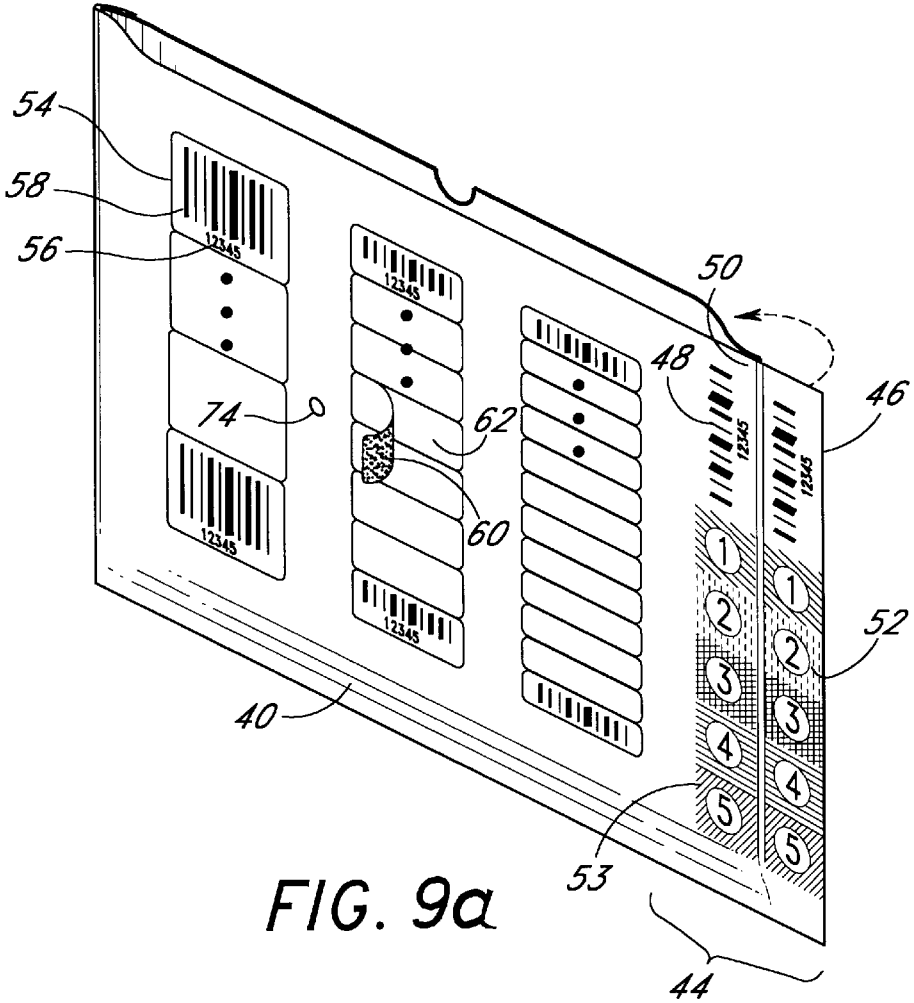
Figure 9C:
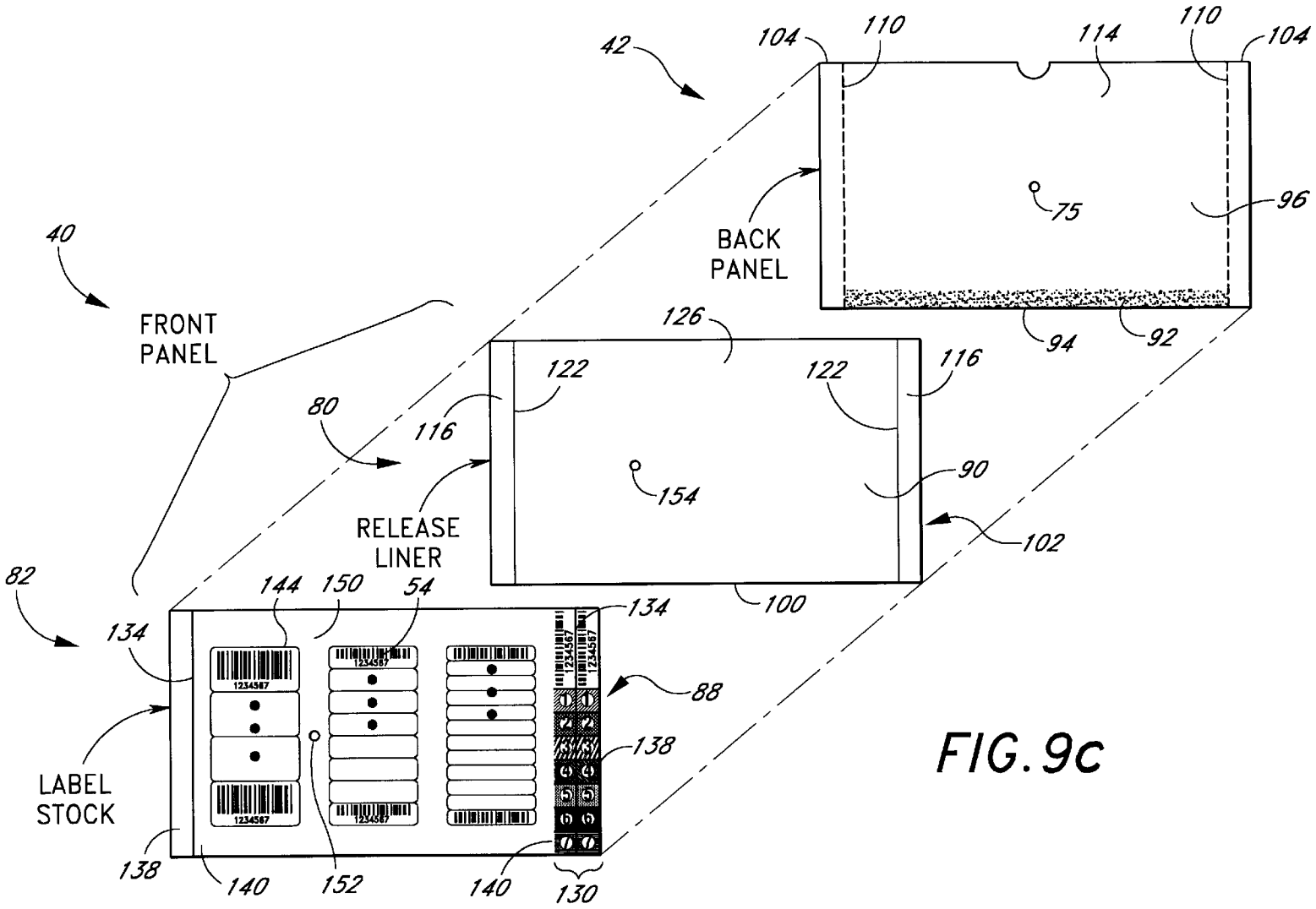
Figure 9E:
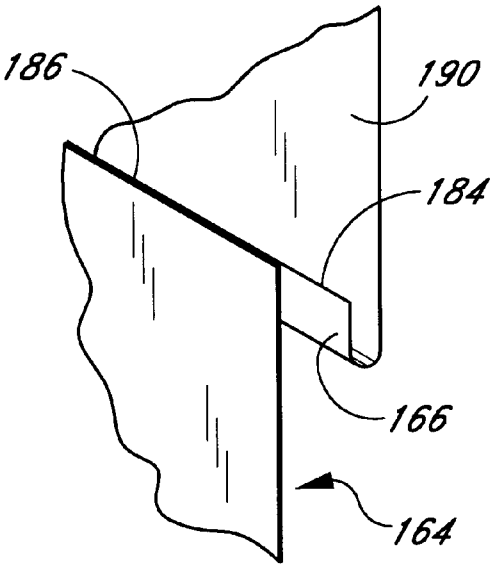
Figure 9D:
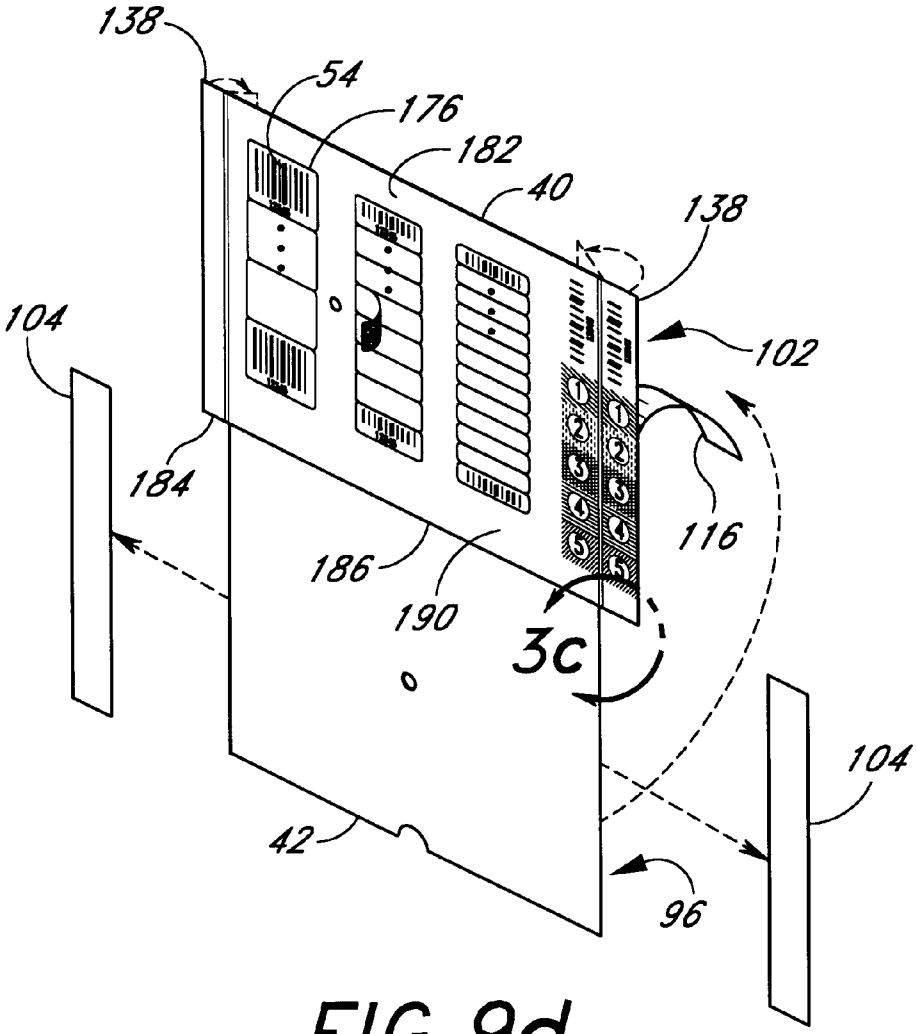
Figure 9F:
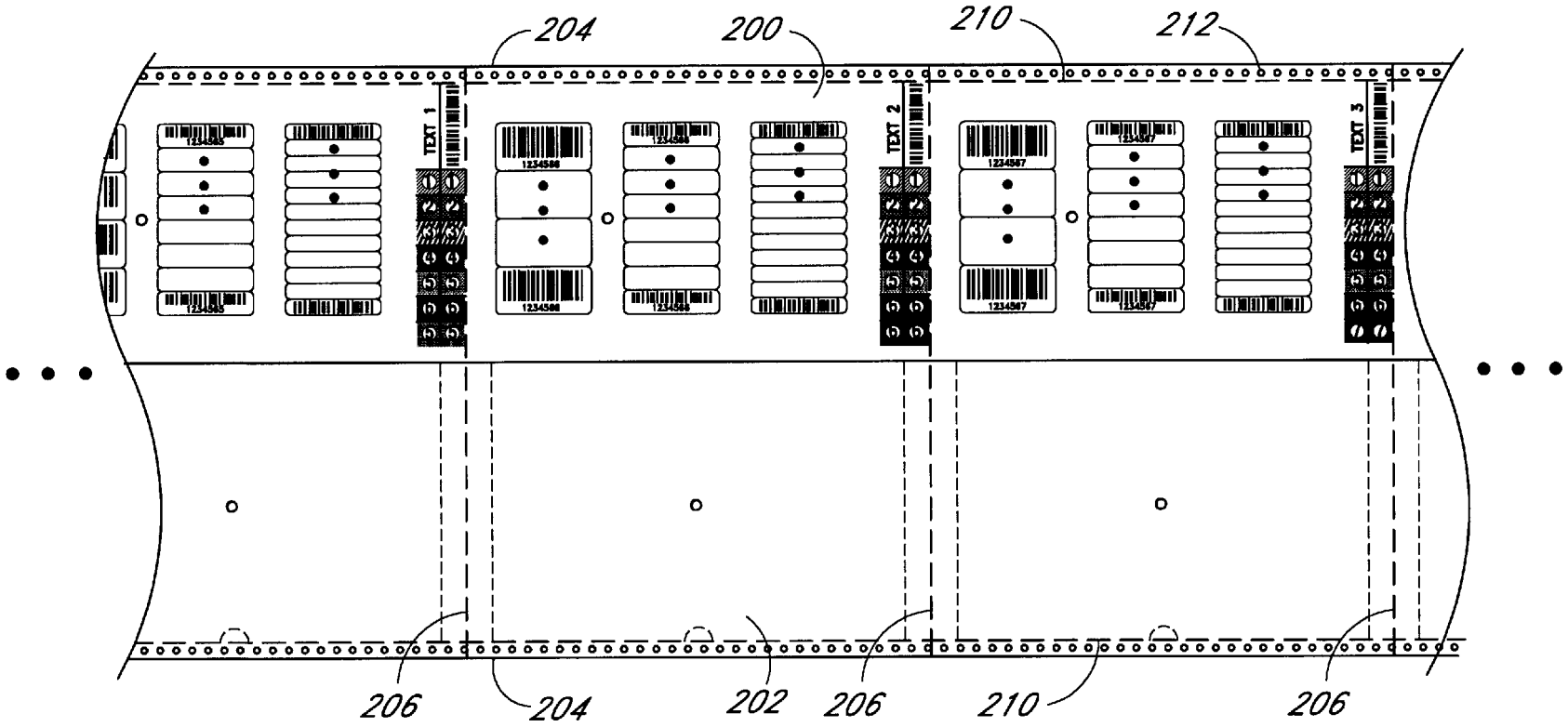
Figure 9G:
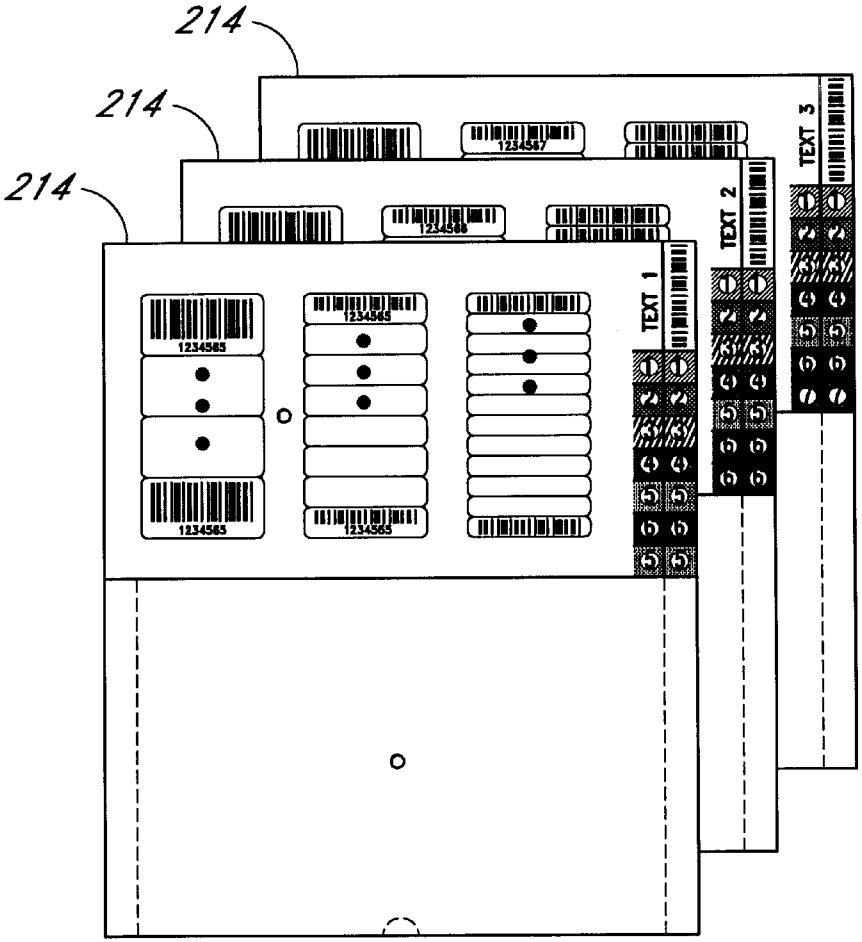

FIG. 8(*a*) illustrates another alternative tab indicia for the preferred embodiment of the improved folder utilizing a colored tab 260 plus a position bar 262. Folders are grouped according to both the tab color and the position of a black bar printed on an alphabetic guide 264. As shown in FIG. 8(*b*), a color wheel 266 specifies the meaning of the tab color. For example, if a filing system identifies folders by company name, the first letter of the first name indicates the alphabetic division (A, B, C, etc.) and hence the location of the position bar on the alphabetic guide. The first letter of the second name indicates the tab color (brown, red, pink, etc.). Single name folders would be filed and color coded under the first letter of the name. Thus, the folder for the company "Murray's Ties" would appear as in FIG. 8(*a*), with the position bar 262 across "M" (for "Murray's") on the alphabetic guide 264 and with a purple folder tab 260 corresponding to the "ST" group 270 (for "Ties") on the color wheel 266 shown in FIG. 8(*b*). On a shelf or in container, specific folder groups printed in this manner can be readily identified. Further folder subdivisions can be created using multiple columns of the alphabetic guides with multiple position bars. As an alternative to a colored tab, a tab could be advantageously printed with a specific shade of gray or a monochrome pattern denoting a particular letter group.

FIGS. 9(*a*) and 9(*b*) show a first alternative embodiment of the improved folder according to the present invention. This embodiment has a front panel 40, a back panel 42 and an integrated tab 44 located on one side of the front panel. The tab has a back portion 46 and a front portion 48 separated by a vertical fold line 50 which is a score or perforation in the panel material. Duplicative tab indicia 52, 53 are printed on both the back 46 and front 48 tab portions. During folder assembly, the printed, integrated tab 44 is folded along the fold line 50 and the back portion 46 is affixed to the back panel 42 as shown in FIG. 9(*b*). Integrated document labels 54 on the front panel are printed with text 56 and machine-recognizable indicia 58 at the same time the integrated tab 44 and other portions of the front panel are printed. These labels have an adhesive backing 60 and can be peeled from the release liner 62 and affixed to folder documents. The front panel 40 and back panel 42 are sealed together along the folder's side 64 and bottom 66 edges to form a pocket 70 in which documents can be stored. The side edges 64 are sealed by the printed integrated tab 44 on one side and the unprinted integrated tab 68 on the other side. Sealing the folder along three edges in this manner advantageously provides increased stability to the folder. In the alternative, one side edge of the folder can remain unsealed, allowing documents to be inserted into the pocket from either the side 64 or the top 72. The front panel 40 and the back panel 42 have air-release holes 74 which allow air trapped in the folder pocket 70 to escape, preventing ballooning of the folder. A finger notch 76 on the top edge of the back panel eases manual separation of the front panel 40 and back panel 42 allowing access to documents contained within the folder pocket 70.

FIG. 9(*c*) shows the construction of this alternative embodiment of the improved folder. The folder is constructed of three layers. A release liner 80 and adhesive-backed label stock 82 together form the front panel 84. The third layer is a back panel 86 made of material which is thicker than the front panel to provide support for the folder yet thin enough to pass through both a printer or a scanner in combination with the front panel. The label stock 82 is layered onto the release liner 80, with the adhesive side 88 of the label stock 82 in contact with the release side 90 of the release liner 80, affixing the two sheets together. A glue line 92 along the bottom edge 94 of the back panel inner side 96 seals the back panel bottom edge 94 to the corresponding bottom edge 100 of the release liner inner side 102 to form the bottom of a document pocket. The back panel 86 has two vertical tear-off portions 104, one on the right side and one on the left side. Easy perforations 110 divide these tear-off portions 104 from the remaining portion 114 of the back panel, allowing the tear-off portions 104 to be removed. The release liner 80 has two corresponding vertical peel-off portions 116 on the right and left sides. Vertical die-cuts 122 divide these peel-off portions 116 from the remaining portion 126 of the release liner 80. The label stock 82 has tab portions 130 on the right and left sides corresponding to the release liner peel-off portions 116 and the back panel tear-off portions 104. Fold perforations 134 in the adhesive sheet 82 divide the back portions 138 from the front portions 140 of the tabs 130. A label die-cut 144 separates a label 54 from the remaining portion 150 of the label stock 82. Multiple label die-cuts may be made as desired for a particular application, creating multiple-labels of advantageous sizes and shapes. The label stock 82 has an air-release hole 152 and the release liner 80 has an air-release hole 154 of identical size and at a corresponding location. The back panel 42 has a similar air-release hole 75.

In FIG. 9(*d*) this alternative embodiment of the improved folder is shown with the front panel 40 attached to the back panel 42. Prior to printing the blank folder is advantageously provided with both panels in an opened position. This configuration allows the front and back panels to be attached before printing but minimizes the thickness of material which must pass through the printer. After printing, folder assembly is completed by bringing the front panel inner side 102 into proximity with the back panel inner side 96. The front panel peel-off portions 116 are then removed to expose an adhesive-backing on the back tab portions 138. The back panel tear-off portions 104 are also removed to allow the back portions of the tabs 138 to be folded and affixed in a folded position against the back panel 42, sealing the folder sides. This creates a document pocket sealed on three sides with an opening at the top as shown in FIG. 9(*a*).

As described above, the front panel implements several useful features for the improved document folder utilizing an easily manufactured construction. The front panel provides removable, adhesive-backed labels; foldable, adhesive-backed end tabs which seal the folder; a printable surface; and a thin profile allowing the front panel, labels and end tab to all be printed at the same time using a standard printer.

Referring back to FIG. 9 (*d*), this alternative embodiment is designed to permit easy printing of the adhesive sheet layer and has several features which minimize the possibility of jamming during high-speed printing operations. The label corners 176 are rounded to minimize the possibility of a peeled-up corner jamming the printer. Also, the labels 54 are flush with the remainder of the label stock 182, which eliminates any discontinuity in the printing surface. The back panel tear-off portions 104, which are removed after printing, also minimize discontinuities in the printing surface at the back tab portions 138.

FIG. 9(*e*) is a detail showing how the front panel bottom edge 184 and the back panel bottom edge 186 are advantageously attached. The front panel bottom edge is folded toward the front panel printed side 190, exposing the front panel inner side 166, which is glued to the back panel inner side 164 at the bottom edge 186.

Referring to FIG. 9(*f*), the first alternative embodiment of the improved folder is shown in a configuration utilized for continuous-feed high-speed printers. A continuous front panel sheet 200 is attached to a continuous back panel sheet 202 in the same manner as detailed in FIG. 3(*d*). Integral tractor-feed strips 204 are incorporated at the top edges of both the front panel and the back panel sheets. Regularly spaced, transverse easy-perforations 206 define the boundary of individual folders and allow the individual folders to be separated from one another. Longitudinal easy-perforations 210 allow the tractor-feed strips 204 to be separated from the folders. The tractor-feed strips 204 contain pin holes 212 which allow a printer's tractor-feed mechanism to guide the connected folders through the printer. After printing, the folders are separated from one another and the tractor-feed strips 204 are removed. The folders are then individually assembled as shown in FIG. 9(*d*). In the alternative, the folders can be configured as individual forms 214, as shown in FIG. 9(*g*) and fed into a printer using a single-sheet feed mechanism.

FIG. 10 shows a second embodiment of the improved folder with the folder tab located at the top edge of the front panel. In this embodiment, the folder front panel 280 is constructed in the same way as the embodiment shown in FIG. 9(*c*), with a label stock 82 affixed to a release liner 80. Referring to FIG. 10, the folder front panel 280 is attached to a back panel 282 in the same way as the alternative embodiment, shown in FIGS. 9(*c*), (*d*) and (*e*). The top tab 284 has a back portion 286 separated from a front portion 290 by a horizontal fold 292. A peel-off portion of release paper 294 is removed after printing to expose adhesive on the back of the top tab 284 and the front panel sides 296. The back panel 282 is then folded up and adhered to the front panel sides 296 to seal those sides and form a document pocket with an opening at the folder top edge 300. The tab 284 is folded in half such that the back portion 286 is affixed to the front portion 290, leaving an unsealed pocket opening at the top edge 300. The tab 284 is printed with folder indicia 302 on both the back 286 and front 290 tab portions. The tab construction of FIG. 10, where the tab is foldable onto itself, also can be advantageously implemented as an end tab. Such an end tab is an alternative to the tab shown in FIG. 9(*d*), where the end tab 138 is folded onto the back panel 42.

Figure 11B:
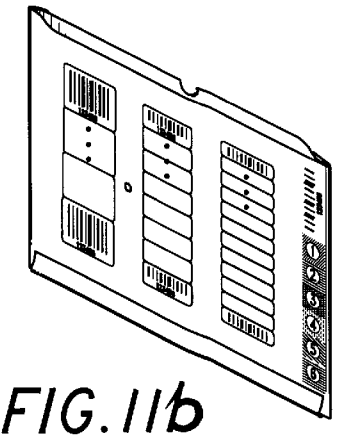
FIG. 11(*a*) is an exploded view of a third embodiment of the improved folder in which the front and back panels are sealed along the side edges with front panel tabs and along the bottom edge with a back panel tab.
Figure 11A:
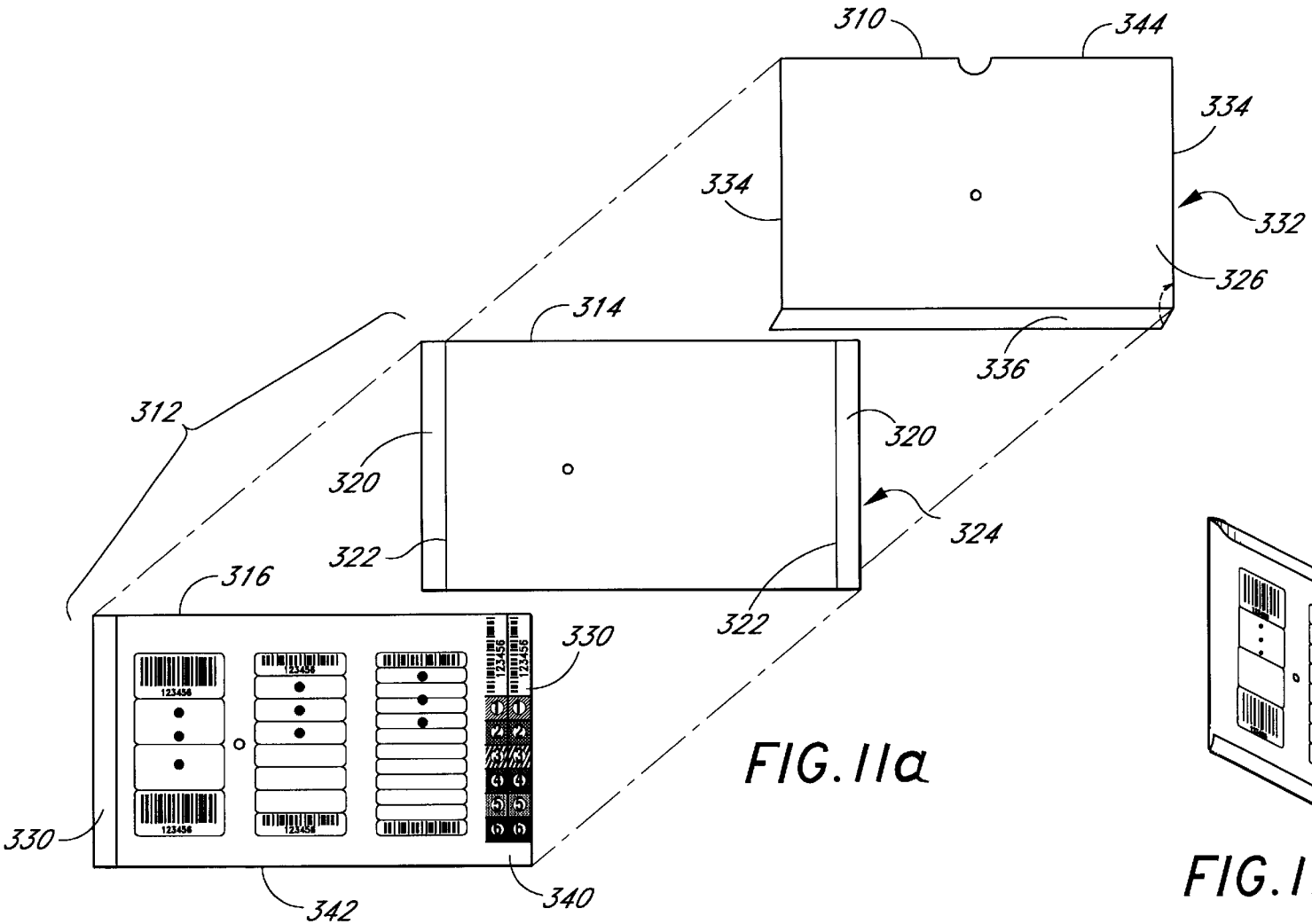

FIG. 11(*a*) shows the construction of a third embodiment of the improved folder. This embodiment is also constructed of three layers, a back panel 310 and a front panel 312 having a release liner 314 affixed to an label stock 316. In this embodiment, the front panel 312 is advantageously printed before it is attached to the back panel 310, minimizing the thickness of material passing through the printer. After printing, peel-off portions 320, created by die-cuts 322 in the release liner 314, are removed. The front panel inner side 324 is then placed in contact with the back panel inner side 326 and the back tab portions 330 of the front panel are folded and affixed to the back panel outer side 332, sealing the folder sides 334. The back panel 310 has a foldable adhesive tab 336 along its bottom edge which is then folded and affixed to the front panel outer side 340, sealing the bottom edge of the folder 342 and creating a document pocket open at the top edge 344, as shown in FIG. 11(*b*).

Figures 12A, 12B:
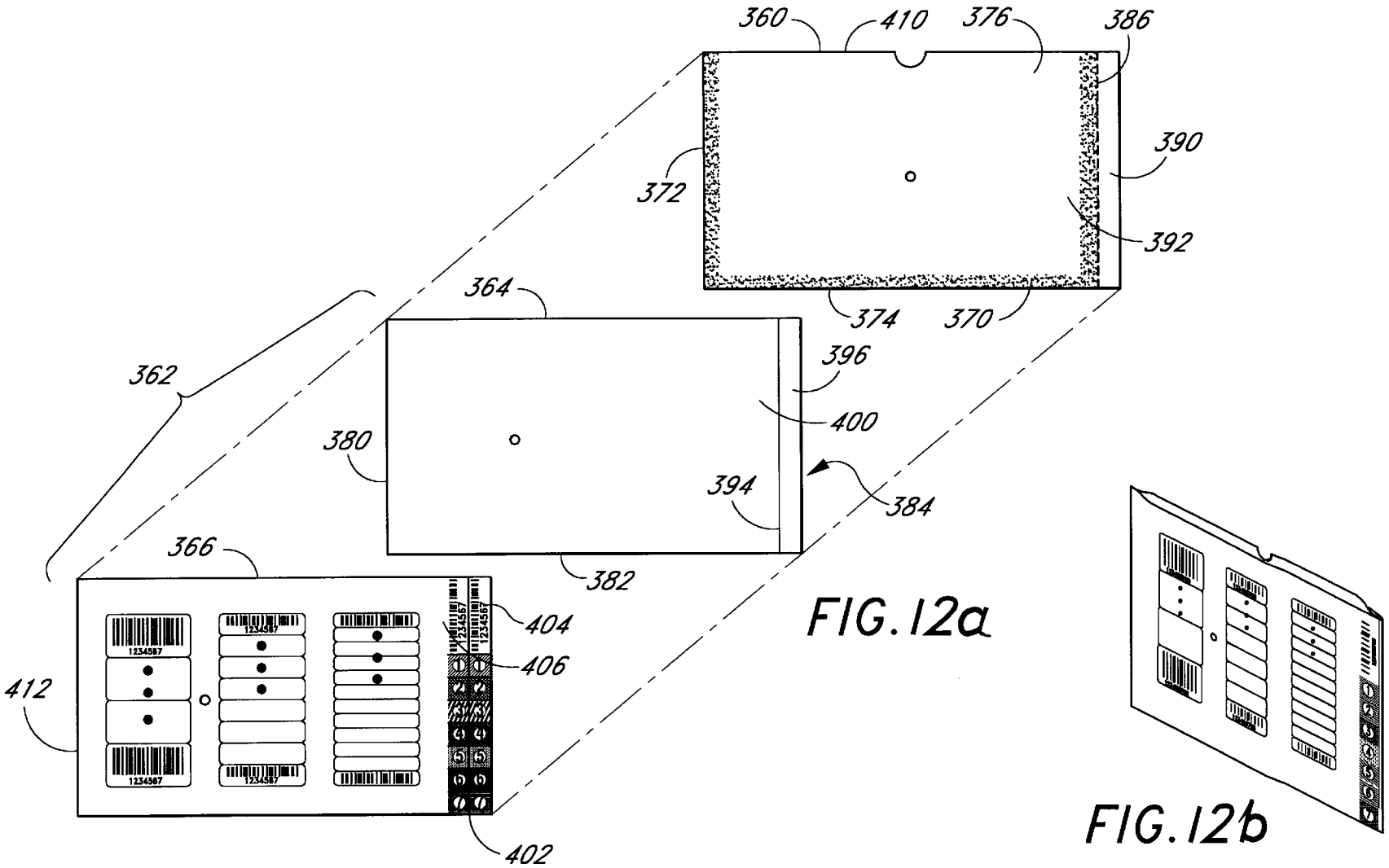
FIG. 12(*a*) is an exploded view of a fourth embodiment of the improved folder in which the front panel and back panels are sealed with a glue-line along the bottom and side edges after the front panel is separately printed.
Figure 12C:
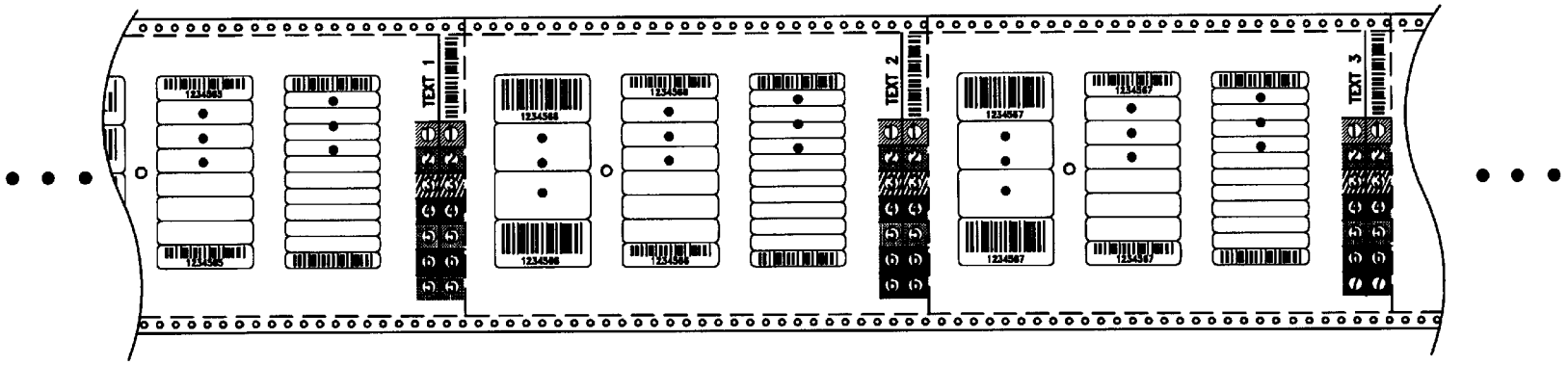
Figure 12D:
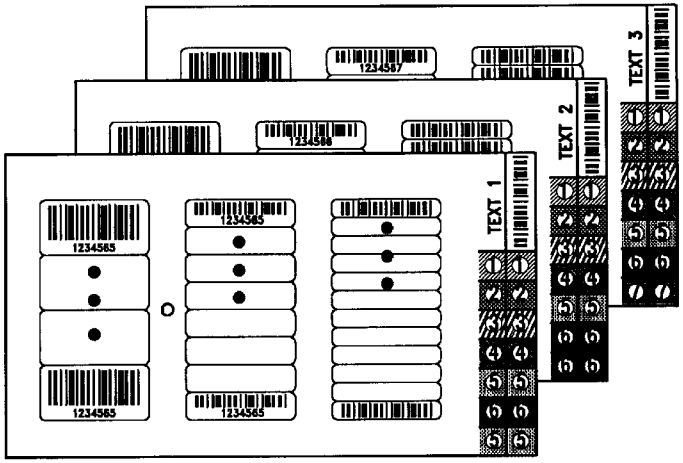

Referring to FIG. 12(*a*), the construction of a fourth alternative embodiment of the improved folder is shown. The folder is again constructed of three layers, a back panel 360 and a front panel 362 having a release liner 364 affixed to an label stock 366. A glue line 370 along the side 372 and bottom 374 edges of the back panel inner side 376 seals these back panel edges to the corresponding side 380 and bottom 382 edges of the front panel inner side 384 to form the folder pocket. A perforation 386 divides the back panel tear-off portion 390 and the remainder of the back panel 392, allowing the tear-off portion 390 to be removed. A release liner die-cut 394 divides a peel-off portion 396 from the remainder of the release liner 400. A fold 402 divides a back tab portion 404 from the remainder of the label stock 406. In this embodiment, the three layers are attached before printing, forming a completed but blank folder with the side and bottom edges sealed and an opening to a folder pocket at the top edge 410. After printing, the tear-off portion 390 is removed. Then the peel-off portion 396 is removed to expose the adhesive on the back of the back tab portion 404, which is folded and affixed to the back panel 360. The presence of the tear-off portion 390 during printing of the folder prevents a discontinuity which might cause jamming of the printer mechanism. After printing, the tear-off portion 390 is removed. In this embodiment, both side edges are sealed and documents must be inserted into the folder pocket at the folder top edge 410, as shown in FIG. 12(*b*). In the alternative, the side edge opposite the tab 412 is advantageously left unsealed to allow documents to also be inserted into the folder pocket at the folder side edge. FIGS. 12(*c*) and (*d*) shown the fourth alternative embodiment configured for continuous-feed printing or single-sheet printing, respectively.

Figure 13A:
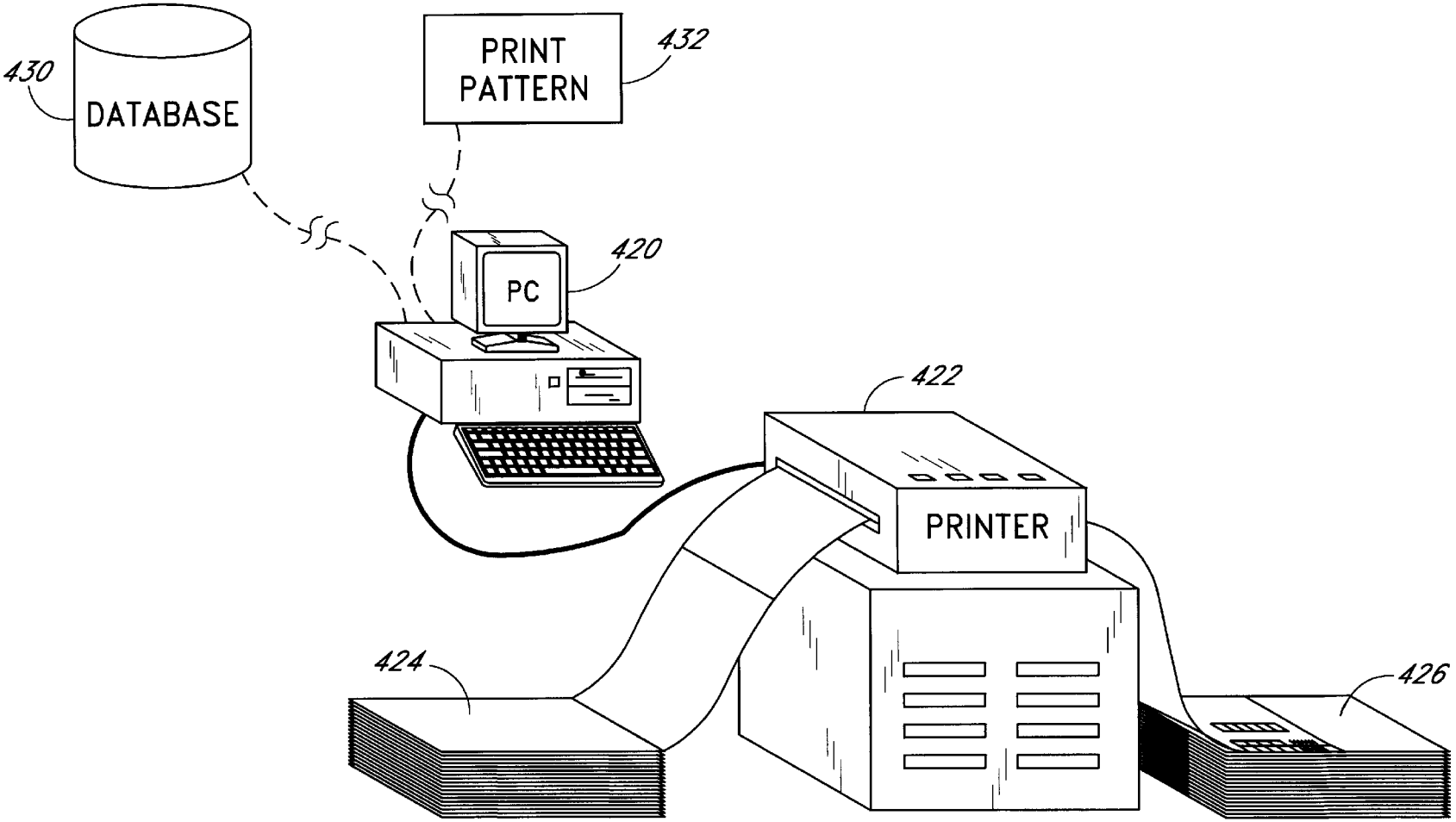
FIG. 13(*a*) is a schematic block diagram of the preferred folder printing system.
Figure 13B:
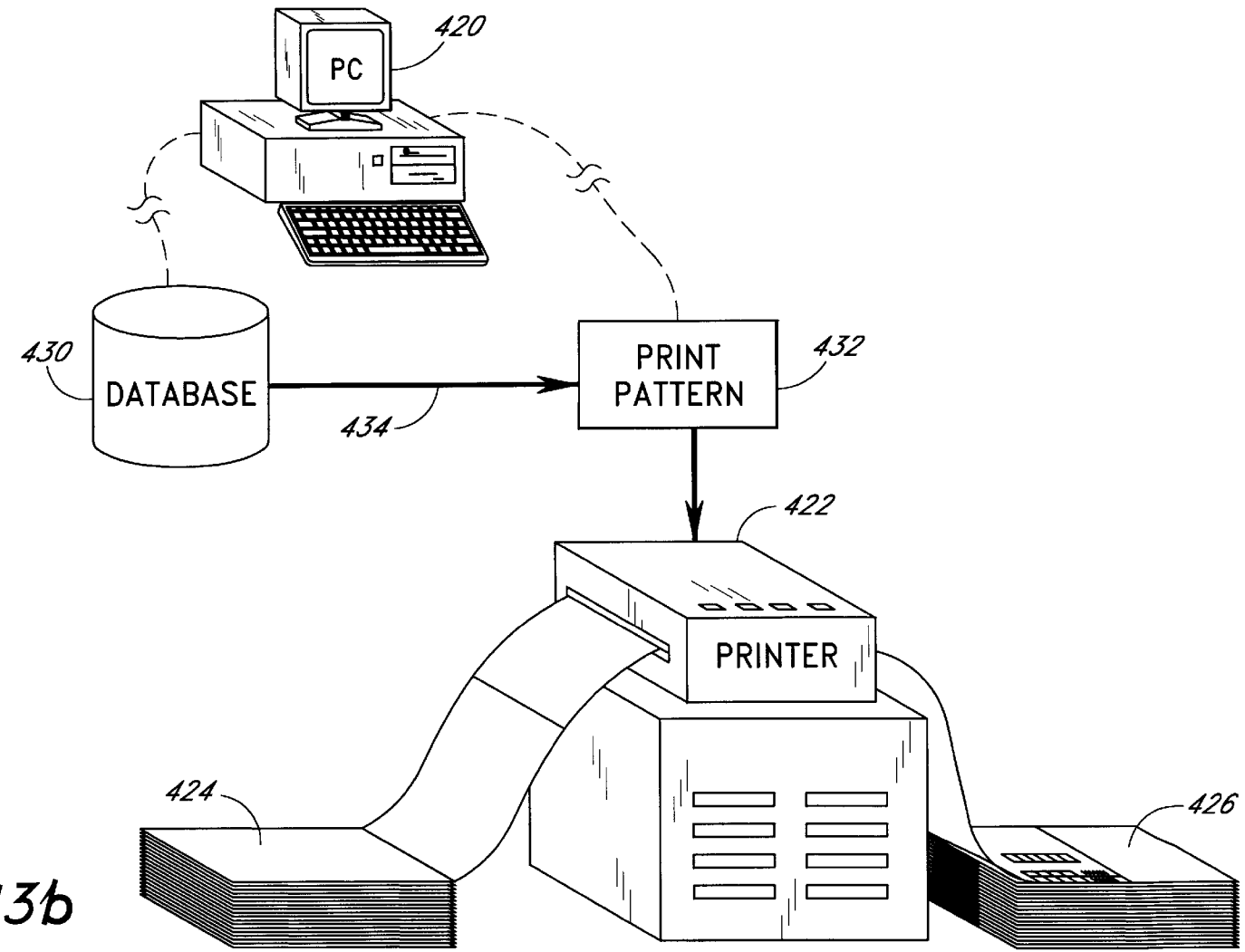

FIG. 13(*a*) schematically illustrates a preferred embodiment of the printing system which prints each folder uniquely in accordance with a selected database entry. In the preferred embodiment of FIG. 13(*a*), the printing system host is a IBM "PC" or compatible computer 420 using an INTEL 486 processor and having a keyboard, a monitor and a hard disk drive. Other computers, for example the APPLE MACINTOSH, can be used as the host. In the preferred embodiment of FIG. 13(*a*), the host is interfaced to a PRINTRONIX Model L5031 printer 422 capable of continuously processing blank folders 424 to produce printed folders 426. Other printers that are capable of accepting the thickness of the folder material can also be used. The blank folders are provided as continuous fanfold sheets as shown in FIG. 3(*c*) or as single-sheets as shown in FIG. 3(*d*). A database 430 residing on the PC hard disk contains information associating specific folders with their sequence identifiers and information regarding the documents in each folder. A print pattern 434 compiles the printer commands and data common to each folder. FIG. 13(*b*) shows the information flow through the printing system. The common print pattern commands and data 432 are merged with specific folder and document data 434 from the database 430 and transferred 436 to the printer 422 for each folder printed. The preferred printing system provides for high-speed data-dependent folder printing. The printing is data-dependent because each folder's tab, document labels and front panel are printed based on the information available on that specific folder in the database. The print pattern, the design of which is described in FIG. 16, utilizes the commonality between folders to reduce the time to compile printer commands and data for each folder. This speeds the printing process.

Figure 14:
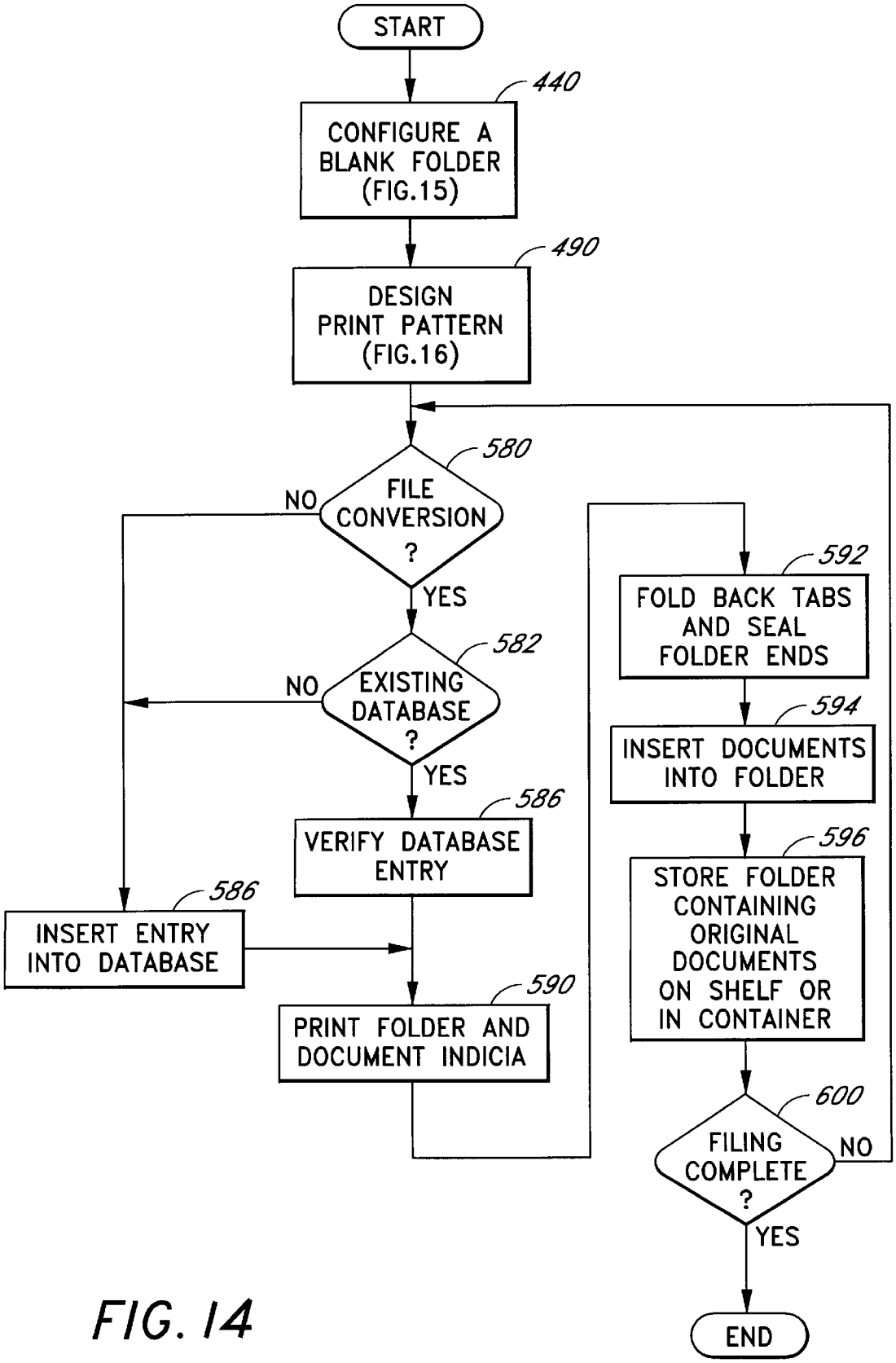
FIG. 14 is a top-level flowchart for the improved folder selecting, printing and assembling processes and the document filing and storing processes using the improved folder.
Figure 15:
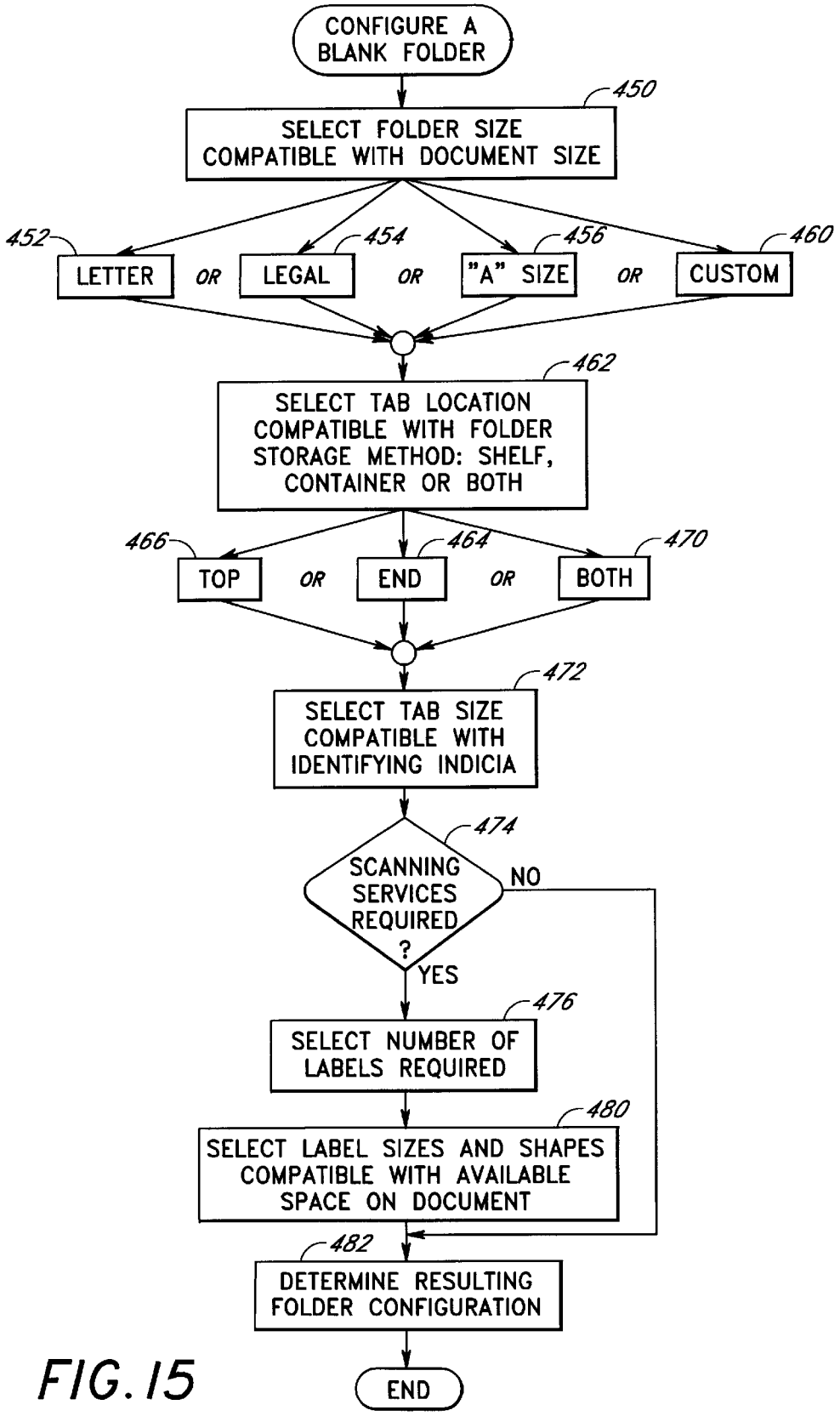
FIG. 15 is a subroutine-level flowchart for determining the physical configuration of the improved folder from application-specific parameters.

As shown in FIG. 14, the method of using the improved folder for a specific filing application begins with determining the physical configuration of the blank folder 440. Referring to FIG. 15, the folder configuration is determined by first selecting a folder size 450. Based on the size of the folder documents, the folder size is determined to be letter 452, legal 454, A size 456 or custom sized 460. Next, the folder tab location is selected 462. If the folder is to be stored on a shelf, an end tab 464 is preferable. If the folder is to be stored in a container, a top tab 466 is preferable. A folder with both top and end tabs 470 is an alternative. The preferred tab size 472 is also selected, constrained by the folder identification method which is to be printed on the tab. If scanning services are required 474, the integrated document labels are specified. The number of labels required 476 is selected based on the number of documents to be labeled. Label sizes and shapes are selected 480 based on the blank space available on the documents to be labeled and the label size preferences. Label sizes and shapes may also be restrained by the document identifying indicia to be printed on the labels. These label parameters determine the die-cut pattern, i.e. the size, shape and quantity of labels on the folder panels. From the foregoing specification of the folder size, tab size and location and label sizes, shapes, quantities and locations, the resulting folder configuration is determined 482. A manufacturing specification for the desired folder can then be printed. Alternatively, if a variety of folder types are maintained in inventory, a part number for the desired folder can be printed.

Referring back to FIG. 14, once a physical folder configuration is determined 440, a print pattern is designed 490. The print pattern design utilizes the folder configuration information determined from the previous step of FIG. 14 in addition to parameters regarding the location and type of information to be printed. This information is translated into a command and data sequence common to all folders for a specific filing application. This common command and data sequence, or pattern, is merged with folder specific data and sent to the printer during the folder printing process. The printer uses the print pattern and the merged data to print a specific folder with integrated tab and label indicia.

Figure 16B:
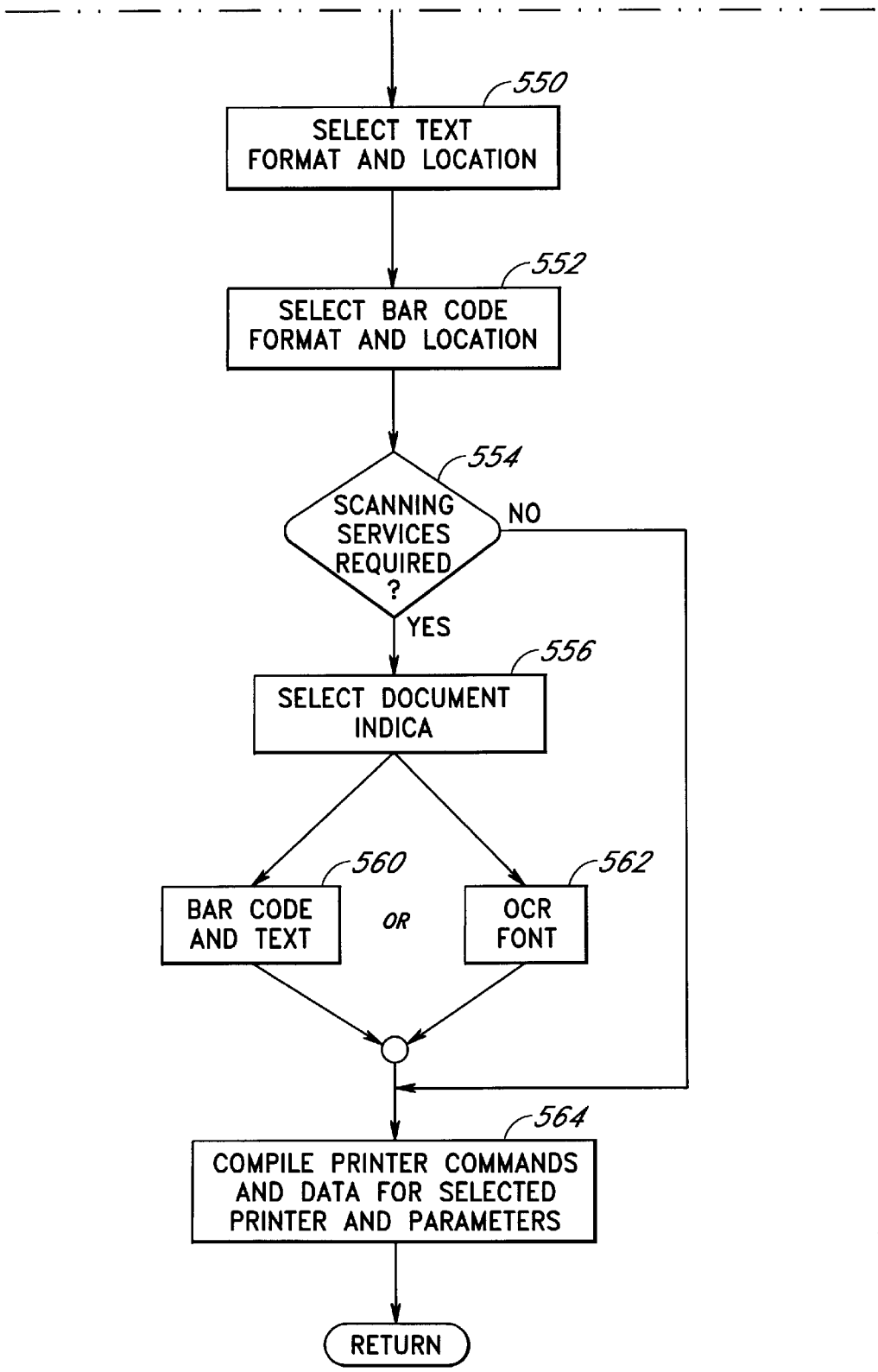
FIGS. 16(*a*) and (*b*) are subroutine-level flowcharts for designing a print pattern for printing the improved folder from application-specific parameters.

Referring to FIG. 16, the print pattern design begins with the specification of the folder configuration 500 and specific printer 502 used. As noted below, the improved folder can be used as a document separator during scanning. This is accomplished by printing a document separator value on the folder which can be recognized by the scanner. A particular document separator value 504 is also specified. There may be no document separator value 506 if scanning is not contemplated. The document separator values may be constant 510 or may be unique to each folder 512. Next, the document separator value location is specified. The document separator value can be printed on the bottom 520, center 512, top 524 or sides 526 of the folder front panel. If color is available on the printer 530, the particular color tab indicia type is specified 532. A unique color block assigned for numerics 534 or color and position bar indicia 536 may be specified. If color blocks are specified, block quantities, sizes and positions are specified. If color is not available, a monochrome indicia type 540 is selected. Monochrome blocks assigned to numerics can be shades of gray 542 or patterns 544. A monochrome tab and position bar 546 can also be used. After the indicia type is specified, the format and location of folder identifying text on the tab is selected 550. Likewise, the folder identifying bar code format and location is selected 552. If scanning services are required 554, folder labels are printed on the folder front panel. The document identifying indicia used on these labels is selected 556. These may be bar code and associated text 560 or an OCR font 562. Once the front panel, tab and document label indicia are specified, a corresponding sequence of printer commands and data for the selected printer is compiled 564, completing the pattern design.

Referring back to FIG. 14, once the physical folder is configured 440 and the print pattern is designed 490, the next step depends on whether this is a file conversion, that is whether this is an existing filing system to be converted to an improved filing system using the improved folder of the present invention, or whether these documents are being filed for the first time. Converting from an existing filing system without sequenced folders or indexed documents to a system with these features using separate processes for printing document and tab labels, matching labels to folders and to documents, and applying labels is very time consuming. Similarly, creating a filing system with these features from the beginning is time consuming. Because all identifying indicia required are printed on each individual, improved folder according to the present invention, the labor intensive aspects of file conversion or creation are eliminated.

If this is a file conversion 580, and the information regarding each folder is maintained on an existing database 582, there is only a need to verify that the database entry is correct 584. Otherwise, identifying information for each folder to be created is entered into a database 586. With this database entry, the remaining folder-specific information is available to the print pattern. Thus, the next step is to print the folder 590. After printing, the folder is assembled with tabs sealing the folder ends 592. Documents to be stored in the folder are inserted into the folder pocket 594, and the folder is stored 596. If filing is complete 600, that is, if all documents are stored into a improved folder, then the process is finished. Otherwise, another folder is begun, starting with database entry verification 584 or creation 586. There may be uses for the improved folder not involving a mass file conversion, where there is simply an advantage in using the improved folder as a tool in the daily process of adding new folders and new documents to the folders. For such uses, there is no database or, alternatively, the database can be considered as having a single entry or a small number of entries.

The image capture process using conventional folders which require documents to be removed from their folders, document separators inserted, a scanning process performed and then the documents reunited with their folders is prone to mixing the wrong folders with the wrong documents. The image capture process of the present invention eliminates this risk by advantageously using the improved folder according to the present invention as a document separator. The improved folder, which is sufficiently thin to pass through a conventional scanner and is printable, is printed with a document separator value which designates it as a document separator and distinguishes it from other documents. Using the improved folder in this manner maintains the folder in close proximity to the documents normally stored in folder while those documents are being scanned.

Figure 17:
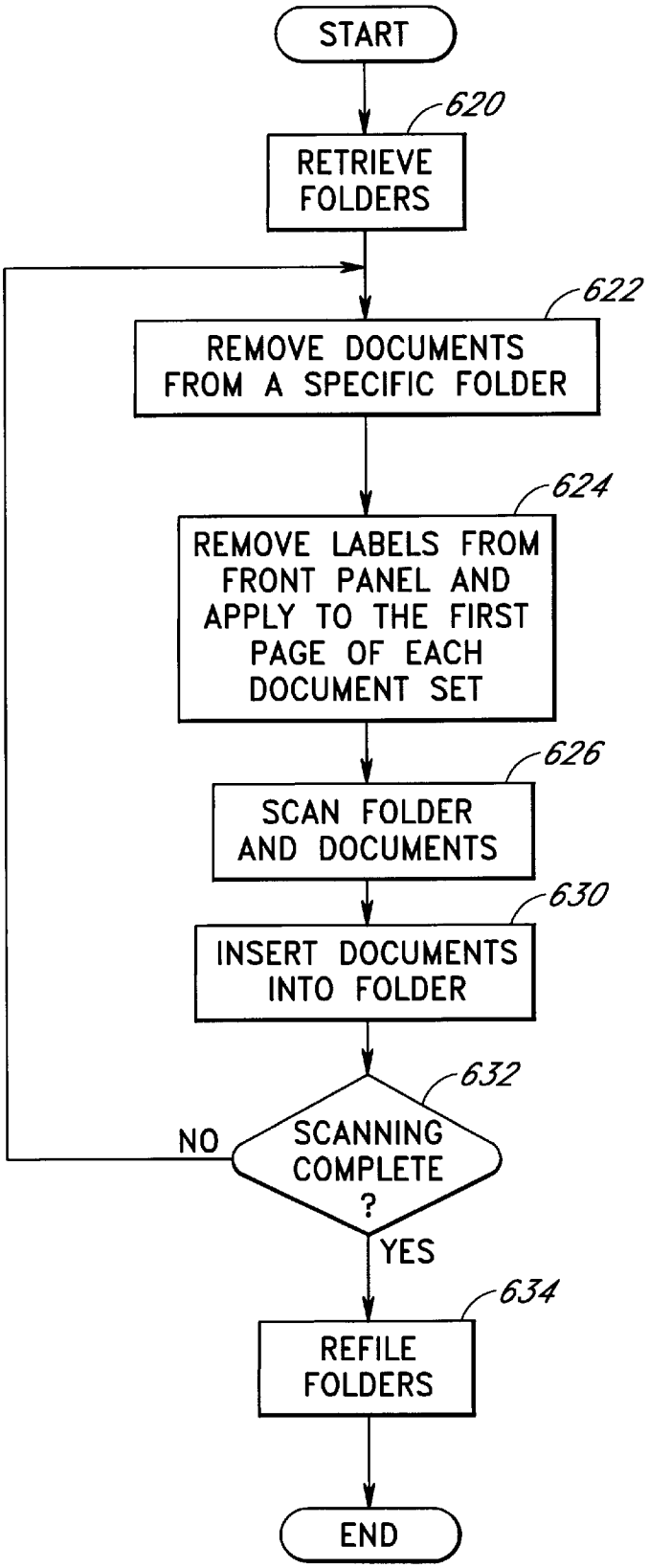
FIG. 17 is a top-level flowchart for utilizing the improved folder to assist document preparation and scanning when optically-stored filing is used.

In FIG. 17, the process of utilizing scanning services with the improved folder is shown. First, the folders to be scanned are retrieved from storage 620. A specific folder is identified and the documents within are removed 622. The document labels on the folder front panel are removed and applied to the first page of each corresponding folder document 624. Next, the documents and folder are scanned together 626, with the folder acting as a document separator from documents contained in the next folder. After scanning, the documents are reinserted into the folder 630. This task is simplified because a folder is scanned with its documents, alleviating the need to match a stack of scanned documents with a stack of empty folders. If all folders have been scanned 630, the folders are refiled or destroyed 634. Otherwise, the next folder to be scanned is identified and the documents removed 622.

What is claimed:

1. A folder blank comprising:

a first generally rectangular panel;

a second generally rectangular panel connected to said first panel, said first and second panels when folded together form a folder sized to hold documents of the type ordinarily found in a business office;

said first panel including an elongated tab on one edge, said tab having a length and a width;

said tab foldable along a line extending along the length of said tab parallel to said one edge of said first panel, whereby when said tab is folded along said fold line any identifying indicia which may be printed on one side of the fold line can be seen from the front of the folder and any identifying indicia which may be printed on the other side of the fold line can be seen from the back of the folder; and said second panel including an elongated portion on one edge, said elongated portion positioned at a location on the edge of the second panel corresponding to the location of said tab on the edge of said first panel such that said folder blank, in its unfolded condition, has an overall generally rectangular shape which permits it to be readily accepted by a printer.

2. The apparatus of claim 1 wherein:

said tab folds around and seals an edge of said second panel, said second portion being adhesively attached to said second panel.

3. The apparatus of claim 1 wherein:

said tab folds onto itself, said second portion being adhesively attached to said first portion.

4. The apparatus of claim 1 wherein:

said tab is located at a side edge of said folder.

5. The apparatus of claim 1 wherein:

said tab is located at a top edge of said folder.

6. The apparatus of claim 1 further comprising indicia directly printed on at least a portion of said front side and substantially identical indicia directly printed on a corresponding portion of said back side of said completed folder tab, said indicia printed in accordance with data uniquely identifying said folder.

7. The apparatus of claim 6 wherein:

said indicia are color blocks, each different color of said color blocks being associated with a unique alphanumeric.

8. The apparatus of claim 6 wherein:

said indicia are a tab color and a block position, said tab color being associated with a unique first alphanumeric, said block position being associated with a unique second alphanumeric.

9. The apparatus of claim 6 wherein:

said indicia are blocks of monochrome patterns, each different pattern being associated with a unique alphanumeric.

10. The apparatus of claim 9 wherein:

said pattern is comprised of a bar superimposed on a contrasting background.

11. The apparatus of claim 10 wherein:

a contrasting alphanumeric symbol is superimposed on said bar and said background.

12. The apparatus of claim 6 wherein:

said indicia comprise a bar code.

13. The folder blank of claim 1 further comprising adhesive located on one side of said folder blank.

14. The folder blank of claim 13 where the adhesive is a layer of contact adhesive with a removable release layer.

15. The folder blank of claim 13 where the adhesive is located on said tab.

16. The folder blank of claim 1 further comprising a weakened line extending along the length of said elongated portion to facilitate the removal of said elongated portion.

17. A folder blank comprising:

a first generally rectangular panel;

a second generally rectangular panel connected to said first panel and together forming a folder for holding documents;

said first panel including an elongated tab on one edge, said tab having a length and a width;

said tab having a weakened fold line extending along the length of said tab parallel to said one edge of said first panel, said fold line dividing the width of said tab into a first portion and a second portion, whereby when said tab is folded along said fold line said first portion is the front side of a completed folder tab and said second portion is the back side of the completed folder tab; and said first panel comprises a release liner removably attached with an adhesive to a printable sheet such that said adhesive adheres to said printable sheet when said release liner is removed, a peel-off portion of said release liner being removable from the back of said second portion to expose said adhesive.

18. An apparatus comprising:

a printable sheet having an extended length and a width bounded by a first side and a second side;

a plurality of equally-spaced weakened tear lines in said sheet, each said tear line being perpendicular to said length and extending from said first side to said second side, wherein said tear lines divide said printable sheet into a series of interconnected folder sections, each one of said folder sections being detachable from said sheet along said tear lines;

a plurality of equally-spaced weakened fold lines in said sheet interleaved with said tear lines, each said fold line being perpendicular to said length and extending from said first side to said second side so as to divide each of said folder sections into a first portion and a second portion, each of said folder sections, when detached from said sheet, being foldable along said fold lines such that said first portion and said second portion form a folder for holding documents; and a plurality of weakened tab lines in said sheet, said tab lines being parallel to said length and extending from said fold lines to said tear lines, each of said folder sections, when detached from said sheet, being foldable along said tab lines so as to form a twosided folder tab.

19. A folder blank comprising:

a first generally rectangular panel;

a second generally rectangular panel connected to said first panel and together forming a folder for holding documents;

said first panel including an elongated tab on one edge, said tab having a length and a width;

said tab foldable along a line extending along the length of said tab parallel to said one edge of said first panel, whereby when said tab is folded along said fold line any identifying indicia which may be printed on one side of the fold line can be seen from the front of the folder and any identifying indicia which may be printed on the other side of the fold line can be seen from the back of the folder;

said second panel includes an elongated removable tab on one edge, said removable tab having a length and a width and adhesive backing;

said removable tab having a weakened tear line extending along the length of said removable tab parallel to said one edge of said second panel, such that said removable tab can be separated from said second panel along said tear line; and said removable tab including a weakened tab fold line extending along the length of said tab parallel to said one edge of said second panel, such that when said removable tab is separated from said second panel, said removable tab can be folded along said tab fold line, placed around a side edge of said folder and adhesively attached to said first and second panels so as to seal said side edge.

20. A folder blank comprising:

a generally rectangular printable sheet having a width bounded by a first side-edge and a second side-edge;

a weakened fold line extending from said first side-edge to said second side-edge and dividing said sheet into a first panel and a second panel of generally equal size;

a weakened tab line extending from said fold line to a top-edge of said first panel, said tab line being parallel and proximate to said first side-edge so as to form a tab portion of said first panel;

a weakened tear line extending from said fold line to a top-edge of said second panel, said tear line being parallel and proximate to said first side-edge so as to form a removable portion of said second panel;

said blank sized and shaped for data-dependent machine printing while in a flat printable position; and said sheet also having a folded position wherein said sheet is folded along said fold line to bring said first panel proximate said second panel, said removable portion is removed, and said first panel is folded along said tab line to attach said tab portion onto said second panel, said sheet in said folded position forming a folder for holding documents.

21. The folder blank of claim 20 further comprising a plurality of removable labels integrated with said sheet, said labels having a printable side and an adhesive side.

22. The folder blank of claim 21 wherein at least a portion of said sheet comprises adhesive-backed label stock and a release liner such that said adhesive adheres to said stock when said release liner is removed, said labels comprising a cut portion of said stock, a peel-off portion of said release liner being removable to expose said adhesive on said tab portion and said labels.

* * * * *

UNITED STATES PATENT AND TRADEMARK OFFICE

CERTIFICATE OF CORRECTION

PATENT NO. : 5,906,397

DATED : May 25, 1999

INVENTOR(S) : Mac Williams, et. al.

It is certified that error appears in the above-identified patent and that said Letters Patent is hereby corrected as shown below:

Column 8, Line 47, " 9/16"3" " should be changed to " 9/16"x3" "

Signed and Sealed this

Twenty-seventh Day of June, 2000

*Attest:*

Q. TODD DICKINSON

*Attesting Officer*

*Director of Patents and Trademarks*